US008208849B2

(12) United States Patent
Hori et al.

(10) Patent No.: US 8,208,849 B2
(45) Date of Patent: Jun. 26, 2012

(54) FILTERING CIRCUIT WITH JAMMER GENERATOR

(75) Inventors: Shinichi Hori, Minato-ku (JP); Boris Murmann, Palo Alto, CA (US)

(73) Assignees: NEC Corporation, Tokyo (JP); The Board of Trustees of the Leland Stanford Junior University, Stanford, CA (US)

( * ) Notice: Subject to any disclaimer, the term of this patent is extended or adjusted under 35 U.S.C. 154(b) by 495 days.

(21) Appl. No.: 12/432,196

(22) Filed: Apr. 29, 2009

(65) Prior Publication Data

US 2010/0279598 A1 Nov. 4, 2010

(51) Int. Cl.
*H04K 3/00* (2006.01)

(52) U.S. Cl. ..... 455/1; 455/63.1; 455/114.2; 455/501

(58) Field of Classification Search ..... 455/1, 63.1, 455/67.13, 114.2, 501
See application file for complete search history.

(56) References Cited

U.S. PATENT DOCUMENTS

| | | | | |
|---|---|---|---|---|
| 3,896,262 | A * | 7/1975 | Hudspeth et al. | 380/207 |
| 2003/0224723 | A1 * | 12/2003 | Sun et al. | 455/12.1 |
| 2009/0190633 | A1 * | 7/2009 | Smith | 375/148 |

* cited by examiner

*Primary Examiner* — Lincoln Donovan
*Assistant Examiner* — Shikha Goyal
(74) *Attorney, Agent, or Firm* — Sughrue Mion, PLLC

(57) ABSTRACT

A filtering circuit with a jammer generator cancels a jammer in wireless signals with little degradation of the signal-to-noise ratio (SNR). The filtering circuit may include a jammer generator which acquires information of period and phase of a sinusoidal jammer signal in a composite input sinusoidal signal, which includes the jammer signal and a desired signal, and outputs a pseudo sine-wave with a period and phase corresponding with the period and phase of the jammer signal acquired, and an adder which outputs a difference between the input and output signals of the jammer generator as the desired signal.

14 Claims, 20 Drawing Sheets

| DAC CODES<br>TERMINAL WITH INPUT OF "L"<br>(ALL OF THE RESTS HAVE AN INPUT OF H) | OUTPUT CURRENT |
|---|---|
| - | A sin(2πx0/80) [= A sin (2πx40/80)] |
| Inp_0 | A sin(2πx1/80) [=A sin (2πx39/80)] |
| Inp_0,inp_1 | A sin(2πx2/80) [=A sin (2πx38/80)] |
| Inp_0,inp_1,···,inp_k (1≤k≤18) | A sin(2πx(k+1)/80) [=A sin (2πx(39-k)/80)] |
| Inp_0,inp_1,···,inp19 | A sin(2πx20/80) |
| Inn_0 | A sin(2πx41/80) [= A sin(2πx79/80)] |
| Inn_0,inn_1 | A sin(2πx42/80) [= A sin(2πx78/80)] |
| Inn_0,inn_1,···,innk (1≤k≤18) | A sin(2πx(41+k)/80) [= A sin(2πx(79-k)/80)] |
| Inn_0,inn_1,···,inn_19 | A sin(2πx60/80) |

FILTERING CIRCUIT WITH JAMMER GENERATOR

BACKGROUND OF THE INVENTION

1. Field of the Invention

Apparatuses and methods consistent with the present invention relate to a filtering circuit, and more particularly to a filtering circuit which can suppress a jammer in a wireless communication system.

2. Description of the Related Art

In a multi-channel wireless communication environment, we have not only the signal in a desired channel, but also jammers in other channels. All of the jammers should be suppressed so strongly that the signal to noise ration (SNR) of the desired signal can be improved to a level necessary for successful wireless communication.

A channel selection filter with the frequency characteristic to pass only the signal in the desired channel is needed to suppress jammers. The bandwidth of the filter corresponds to that of the channel bandwidth.

A short-range communication system has a narrow channel bandwidth of less than 1 MHz, while some other communication systems have much wider channel bandwidths, for example, 20 MHz for Wi-Fi and more than 4 GHz for ultra-wideband (UWB).

Generally, in an integrated circuit (IC), the die area of an analog filter is inversely proportional to the frequency bandwidth. This means that the analog channel selection filter in a short-range communication system would typically occupy more than half of the entire wireless IC. A digital filter is used for channel selection in most of the commercial wireless IC's for a short-range communication system since a digital filter can be implemented with much smaller area than an analog filter.

In the case of using a digital filter for channel selection, analog signals including the desired signal and jammer signals must be converted to digital signals before suppressing jammers. Given that a wireless IC should provide successful communication under jammers 40 dB larger than the desired signal, an analog-to-digital converter (ADC) should have a 40 dB wider dynamic range than it should have without the presence of jammers. Therefore, the ADC is required to have higher resolution, leading to larger power consumption.

The block diagram shown in FIG. 1 is a proposed architecture to suppress jammers without any analog filters as an example of background art.

This architecture has two signal paths between a mixer circuit and an ADC.

In the first path, the jammers are extracted from the input signal by suppressing a desired signal. The input signal to the first path is converted to a digital signal using an ADC with a low resolution. Subsequently, only the desired signal is suppressed using a digital band stop filter. Finally, the digital signal that contains only the jammers is converted back to an analog signal.

In the second path, the input signal is delayed such that that jammers in the output of the second path are synchronous with jammers in the output signal of the first path.

The output signal from the first path consists of only jammers while the output signal from the second path consists of the desired signal and jammers. The jammers can be suppressed by subtracting the output signal in the first path from the output signal from the second path.

Since this architecture shown in FIG. 1 does not contain analog filters, it can be realized with a smaller integrated circuit die area than previous architectures having analog filters. In addition, the required ADC resolution can be reduced since the jammers are suppressed before reaching the second ADC.

However, the architecture shown in FIG. 1 has the severe problem of introducing noise to the system.

The delay circuit in the second path consists of sample and hold circuits connected in series as shown in FIG. 2.

The number of sample and hold circuits, Nc, is equal to the total delay time required for the delay circuit, Td, divided by the sampling time of the sample and hold circuit, Ts, as in the following equation 1:

$$Nc=Td/Ts \qquad \text{Equation 1}$$

Td is set to a value equal to the delay time seen by the jammers going through the first path. This delay is nearly equal to the reciprocal of the bandstopwidth of the digital band stop filter in the first path, which corresponds with the bandwidth of the desired channel.

Ts is typically set to one-quarter of the reciprocal of the entire bandwidth of all the signals including the desired signal and jammers.

This architecture usually needs more than 100 sample and hold circuits in a narrow band communication system.

Since a delay circuit introduces noise, such as thermal noise and switching noise, this architecture makes the SNR significantly worse.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a filtering circuit occupying a small integrated circuit die area and having a high SNR.

An aspect of the present invention provides a filtering circuit.

The filtering circuit may include a jammer generator, which includes a detector to acquire information about the period and phase of a jammer signal in a composite input sine-wave signal, which includes the jammer signal and a desired signal, to the jammer generator, and a pseudo sine-wave generator to output a pseudo sine-wave signal whose period and phase correspond with those of the jammer signal acquired at the detector; and an adder which outputs a difference between an input and an output signal of the jammer generator as the desired signal.

Another aspect of the present invention provides a variable gain amplifier whose output signal is input to the jammer generator.

Yet another aspect of the present invention provides a gain controlling circuit which includes a circuit for acquiring information of the amplitude of the jammer signal in the composite input signal and adjusts the gain of the variable gain amplifier so that the amplitude of the jammer signal in the output of the variable gain amplifier corresponds with that of the output of the jammer generator.

The present invention generates a pseudo-sine wave signal whose frequency, phase, and amplitude are approximately equal to those of a jammer included in a wireless signal and then outputs a difference between the wireless signal and the pseudo sine wave signal to yield a desired signal. As a result of the above, jammer suppression in a wireless signal may be achieved without any analog delay circuit.

Still another aspect of the present invention provides a method of detecting a desired signal in the presence of jammer signals, the method, including acquiring information of period and phase of an input sine-wave signal with a detector, generating a pseudo sine-wave signal whose period and phase correspond with the period and phase of the input sine-wave signal of a pseudo sine-wave generator, adding the input sine-wave signal at a non-inverting terminal of an adder and the pseudo sine-wave signal at an inverting terminal of the adder, and outputting a difference between the input sine-wave signal and the pseudo sine-wave signal.

Aspects of the present invention can make it possible to realize a filtering circuit with a small die area and a little degradation of signal-to-noise ratio (SNR).

BRIEF DESCRIPTION OF THE DRAWINGS

These and other aspects of the invention will become apparent and more readily appreciated from the following description of the exemplary embodiments, taken in conjunction with the accompanying drawings in which.

DETAILED DESCRIPTION OF THE EXEMPLARY EMBODIMENTS

Hereinafter, certain exemplary embodiments of the present invention will be described in detail with reference to the accompanying drawings. The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

First Exemplary Embodiment

Figure 1:
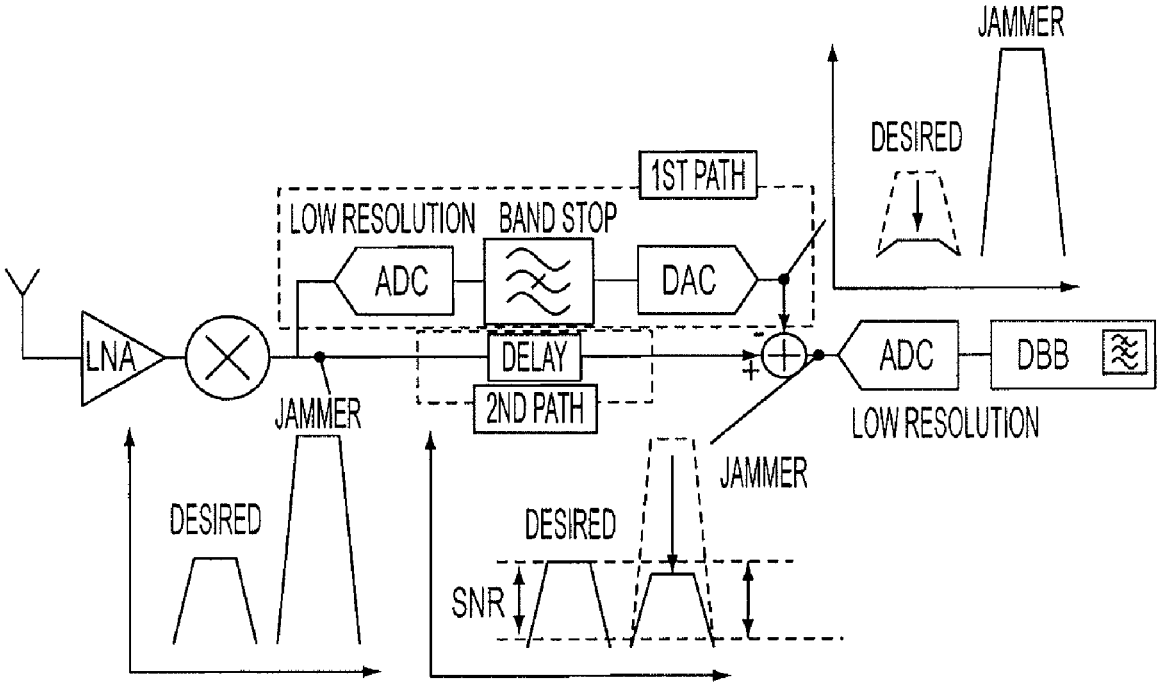
FIG. 1 PRIOR ART
FIG. 1 is a block diagram illustrating a proposed related architecture to suppress jammers without any analog filters.
Figure 2:
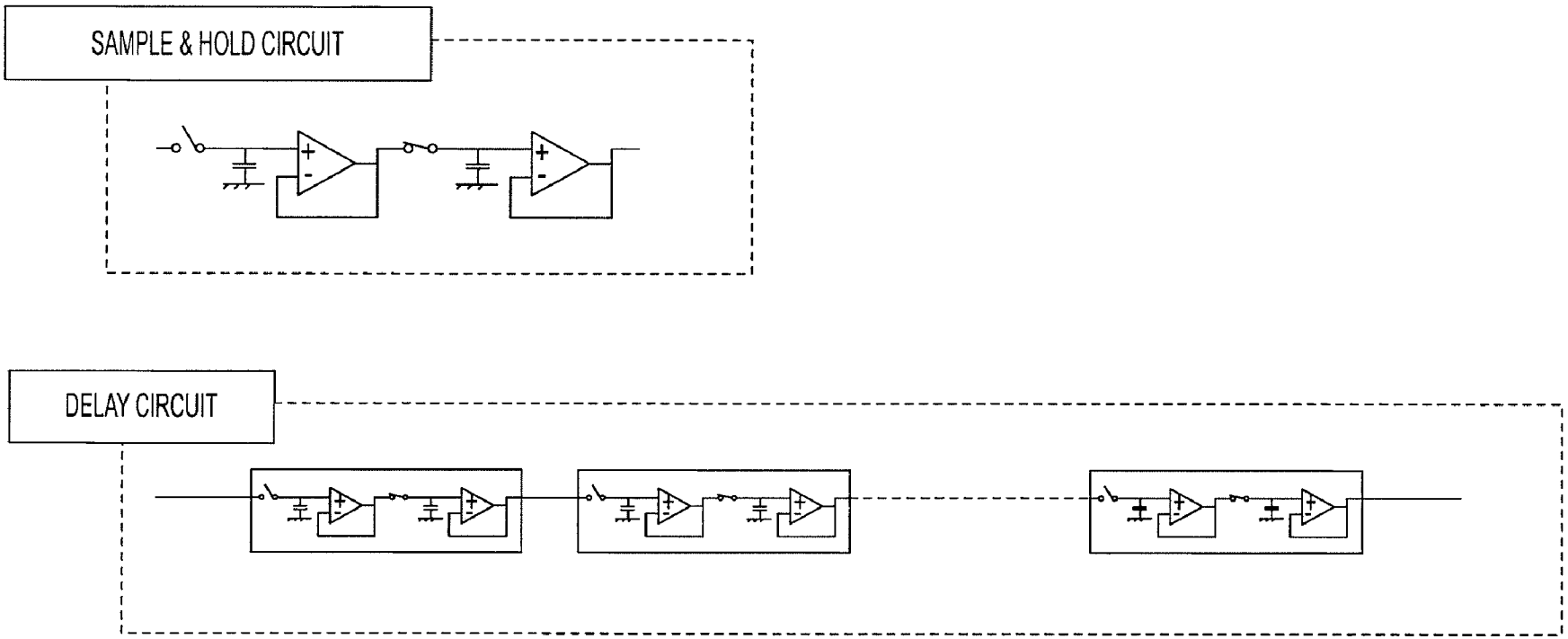
FIG. 2 PRIOR ART
FIG. 2 is a block diagram illustrating a sample and hold circuit and a delay circuit of FIG. 1.
Figure 3:
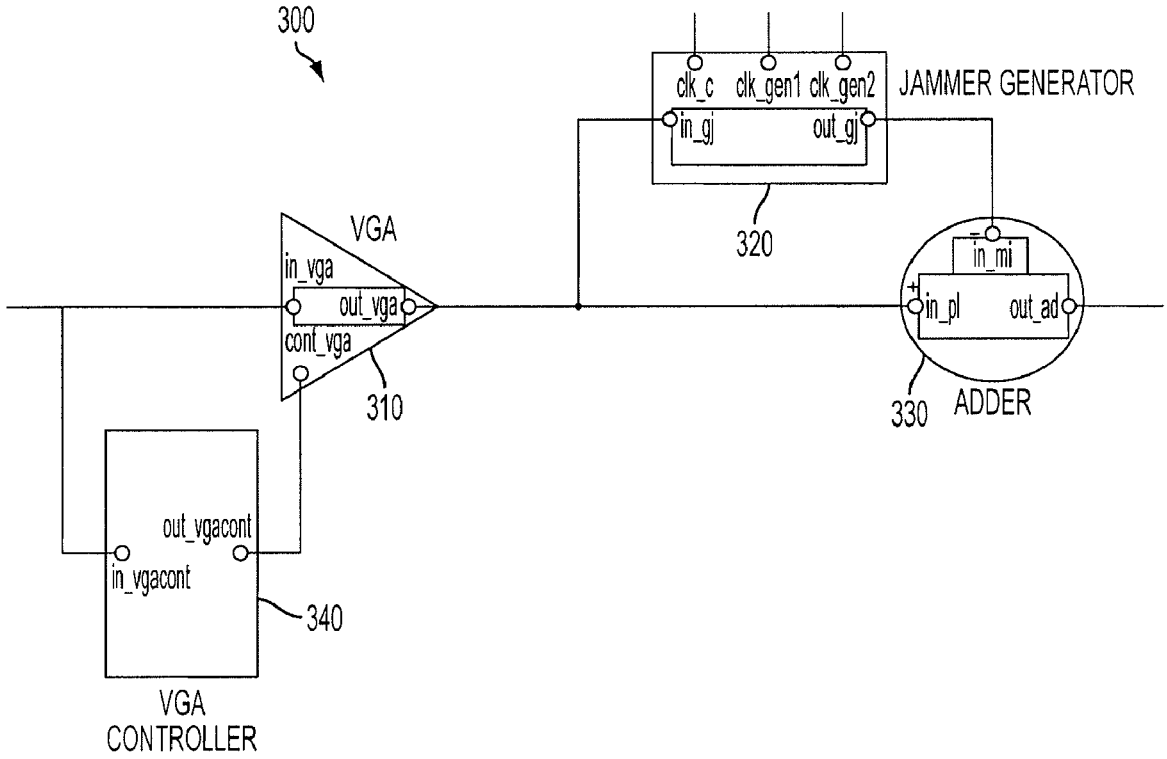
FIG. 3 is a block diagram illustrating a filtering circuit with a jammer generator according to a first exemplary embodiment of the present invention.

FIG. 3 is a block diagram illustrating a filtering circuit with a jammer generator according to a first exemplary embodiment of the present invention.

The first exemplary embodiment of the filtering circuit 300 contains a variable-gain amplifier (VGA) 310, a jammer generator 320, an adder 330, and a VGA-controller 340.

The VGA 310 adjusts the amplitude of its output signal by varying its gain. The gain may be controlled via an external control signal. The VGA-controller 340 controls the VGA gain so that the amplitude of the VGA output signal may be set to a desired value. The jammer generator 320 identifies the frequency and phase of its input signal, i.e., the VGA output signal, and then outputs a sinusoidal signal with the same frequency and phase as its input signal and with preset amplitude. The adder 330 outputs a difference between signal voltages input at its positive (+) terminal and negative (−) terminals.

The input terminal of the first exemplary embodiment of the filtering circuit 300 is internally connected to the input terminals of the VGA 310 and the VGA-controller 340. The output terminal of the VGA 310 is connected to the input terminal of the jammer generator 320 and the positive (+) terminal of the adder 330. The output terminal of the VGA-controller 340 is connected to a control terminal of the VGA 310. The output terminal of the jammer generator 320 is connected to the negative (−) terminal of the adder 330. The output terminal of the first exemplary embodiment of the filtering circuit 300 is internally connected to the output terminal of the adder 330.

In a wireless communication environment, a plurality of channel signals (Smulti) may be input to this exemplary embodiment simultaneously. One channel signal in the plurality of channel signals Smulti is a desired signal (S1) and the other channel signals are all considered jammers. Here, it is assumed that the power of a specific jammer (J1) is higher by Pj1 dB than the summation of the power of any other channel signal including S1. It is also assumed that the modulation type of J1 is frequency-shift-keying (FSK) and its modulation index, frequency deviation, and carrier frequency are known as m, Fdiv (Hz), and Fc (Hz), respectively.

Smulti is processed by the VGA 310 for amplitude adjustment and then fed to the input terminal of the jammer generator 320 and the positive terminal of the adder 330. The jammer generator 320 identifies the information of the frequency and phase of J1 in Smulti and outputs a sinusoidal signal with the same frequency and phase as J1. This sinusoidal signal is input to the negative terminal of the adder 330. The VGA controller 340 identifies the magnitude of the amplitude of J1 in Smulti and controls the VGA gain so that the amplitude of the VGA output signal is approximately equal to that of the output signal from the jammer generator 320. Thus, the J1 signal at the positive terminal of the adder 330 almost agrees with the sinusoidal signal at the negative terminal of the adder 330 in amplitude, frequency and phase. Therefore, only J1 in Smulti is suppressed at the output terminal of the adder 330.

The configuration and operation of the respective circuit blocks are described as follows.

Figure 11:
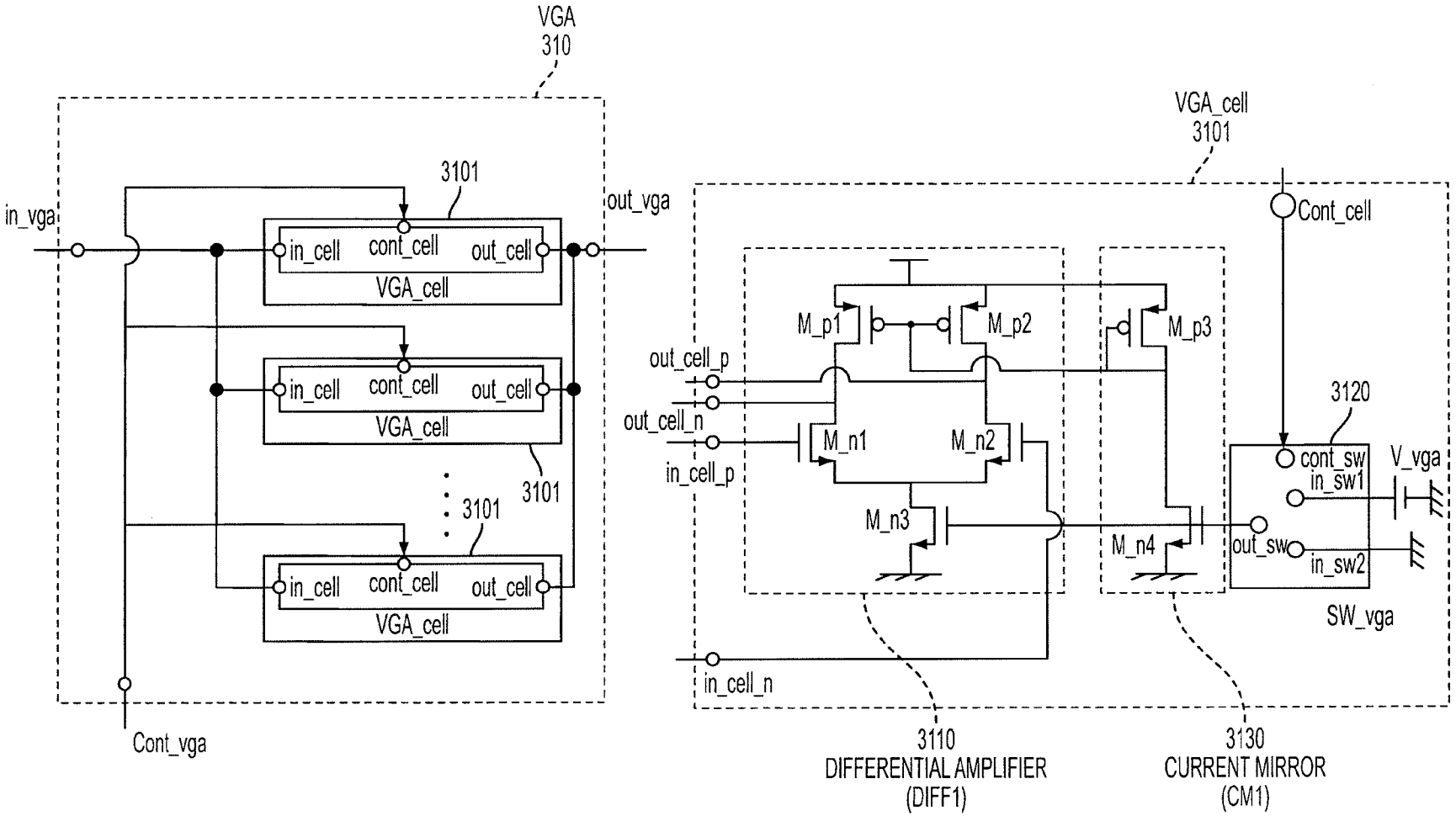
FIG. 11 is a circuit diagram illustrating a configuration of a variable gain amplifier (VGA) according to the first exemplary embodiment of the present invention.

FIG. 11 is a circuit diagram illustrating a configuration of a VGA 310 according to the first exemplary embodiment of the present invention.

The VGA 310 may include a number, N, of VGA_cells 3101 and has a differential input terminal (in_vga), differential output terminal (out_vga), and N-bit control terminal (cont_vga). Each VGA_cell 3101 has a differential input terminal (in_cell), differential output terminal (out-cell), and a control terminal (cont_cell). The differential input terminal of the VGA 310, in-vga, is internally connected to the differential input terminals of all the VGA_cells 3101, in_cell. The differential output terminal of the VGA 310, out_vga is also internally connected to the differential output terminals of all the VGA_cells 3101, out_cell. The N-bit control signal input to the N-bit control terminal of the VGA 310, cont_vga, provides a logic signal to the control terminal of each VGA_cell, respectively.

The VGA_cell 3101 may include a differential amplifier (DIFF1) 3110, a switch circuit (SW_VGA) 3120, and a current mirror circuit (CM1) 3130. DIFF1 3110 may include three N-type MOSFETs (M_n1, M_n2, M_n3) and two P-type MOSFETs (M_p1, M_n2). The sizes of M_n1 and M_p1 are the same as the sizes of M_n2 and M_p2, respectively. The gate terminals of M_n1 and M_n2 are referred to as the differential input terminal of the VGA_cell 3101, in_cell_p and in_cell_n. The source terminals of M_n1 and M_n2 are connected to a drain terminal of M_n3 which serves as a current source. The source terminal of M_n3 is connected to a ground line. M_p1 and M_p2 serve as current sources. The source terminals of M_p1 and M_p2 are connected to the power line and the drain terminals of M_p1 and M_p2 are connected to the drain terminals of M_n1 and M_n2, respectively. CM1 3130 may include an N-type MOSFET (M_n4) and a P-type MOSFET (M_p3). The drain terminal of M_n4 is connected to the drain terminal of M_p3 and the source terminal of M_n4 is connected to the ground line. The source terminal of M_p3 is connected to the power line and the gate and drain terminal of M_p3 are connected with each other. The size of M_n4 is the same as the size of M_n3. The gate width of M_p3 is twice larger than that of M_p1, or M_p2. The gate terminal and drain terminal of M_p3 are connected to the gate terminals of M_p1 and M_p2 in DIFF1 3110, respectively.

The switching circuit, SW_VGA 3120, has two input terminals (in_sw1, in_sw2), an output terminal (out_sw1), and a control terminal (cont_sw1). The control terminal cont_cell of VGA_cell 3101 is internally connected to the control terminal cont_sw1 of SW_VGA. The output terminal out_sw1 of SW_VGA 3120 is connected to the gate terminal of M_n4 in CM1 3130 and the gate terminal of M_n3 in DIFF1 3110. The input terminal in_sw1 of SW_VGA 3120 is connected to an external voltage source (V_vga). The input terminal in_sw2 of SW_VGA 3120 is connected to the ground line. Input terminal in_sw1 of SW_VGA 3120 is connected to output terminal out_sw1 of SW_VGA 3120 when a high logic signal is applied to control terminal cont_sw1 of SW_VGA 3120, and input terminal in_sw2 of SW_VGA 3120 is connected to output terminal out_sw1 of SW_VGA 3120 when a low logic signal is applied to control terminal cont_sw1 of SW_VGA 3120.

The voltage value of V_vga is determined so that the drain current of M_n3 can be a desired value (I_s1) when voltage value of V_vga is applied to the gate terminal of M_n3. The drain current of M_n4 is equal to that of M_n3 since their sizes are the same.

When a high logic signal is applied to control terminal cont_sw1 of SW_VGA 3120, V_vga is connected to the gate terminals of M_n3 in DIFF1 3110 and M_n4 in CM1 3130. Then, the drain currents of M_n3 and M_n4 are equal to I_s1. Also, the drain currents of M_p1 and M_p2 are equal to half of I_s1 since both of the gate widths of M_p1 and M_p2 are half of the gate width of M_p3, whose drain current is equal to I_s1. Accordingly, a differential output current of the VGA_ cell is almost zero when the differential input signal is zero. When a differential input voltage, V_incell, is input to input terminals in_cell_p and in_cell_n of VGA_cell 3101, a differential output current from VGA_cell 3101, I_outcell, is expressed by the following equation 2.

$$I_\text{outcell}=(gm_\text{cell})(V_\text{incell}) \qquad \text{Equation 2}$$

where gm_cell represents the gm value of M_n1 or M_n2.

When a low logic signal is applied to control signal cont_sw1 of SW_VGA 3130, the gate terminals of M_n3 in DIFF1 3110 and M_n4 in CM1 3130 are connected to the ground line. Accordingly, the output current from the VGA_cell 3101 is zero for any input signal applied to input terminals in_cell_p and in_cell_n of VGA_cell 3101.

The output current from VGA 310 is equal to the sum of the output currents from all VGA_cells 3101 in VGA 310. When a differential input voltage, V_invga, is input to in_vga of VGA, 310 a differential output current from VGA 310, I_outvga, is expressed as the following equation 3:

$$I_\text{out_vga}=(M_\text{vga})(gm_\text{cell})(V_\text{invga}) \qquad \text{Equation 3}$$

where M_vga represents the number of the VGA_cells 3101 for which a high logic signal is applied to the control terminal cont_cell. M_vga is a value controllable in the range from 1 to N by the control signal applied to control terminal cont_vga of VGA 310.

Figure 12:
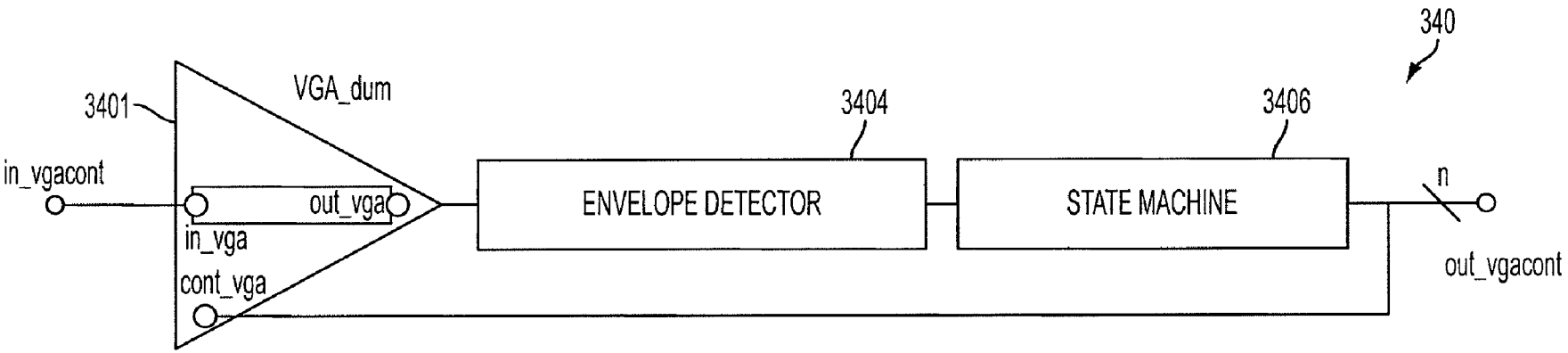
FIG. 12 is a block diagram illustrating a configuration of a VGA-controller according to the first exemplary embodiment of the present invention.

FIG. 12 is a block diagram illustrating a configuration of a VGA-controller according to the first exemplary embodiment of the present invention.

The VGA-controller 340 may include a variable-gain amplifier (VGA_dum) 3401, an envelope detector 3404, and a state machine 3406. The VGA-controller 340 has a differential input terminal (in_vgacont) and an N-bit output terminal (out_vgacont). The circuit configuration and operation of the VGA_dum 340 are the same as those of the VGA 310 shown in FIG. 11. The envelope detector 3404 has a differential input terminal and an output terminal. The state machine 3406 has an input terminal and an output terminal.

The input terminal in_vgacont of the VGA-controller 340 is internally connected to the input terminal in_vga of VGA_dum 3401. The output terminal out_vga of VGA_dum 3401 is connected to the differential input terminal of the envelope detector 3404. The output terminal of the envelope detector 3404 is connected to the input terminal of the state machine 3406. The output terminal out_vgacont of VGA_controller 340 is internally connected to the output terminal of the state machine 3406 and the control terminal (cont_vga) of VGA_dum 3401.

The envelope detector 3404 acquires amplitude information of an input signal and outputs a DC value corresponding to the amplitude information. The output DC value of the envelope detector 3404 is input to the state machine 3406. The state machine 3406 outputs an N-bit logic signal corresponding to the input value by referring to a lookup table, and controls the gain of VGA_dum 3401 so that the amplitude of the VGA_dum 3401 output signal is approximately equal to the desired value.

Figure 4:
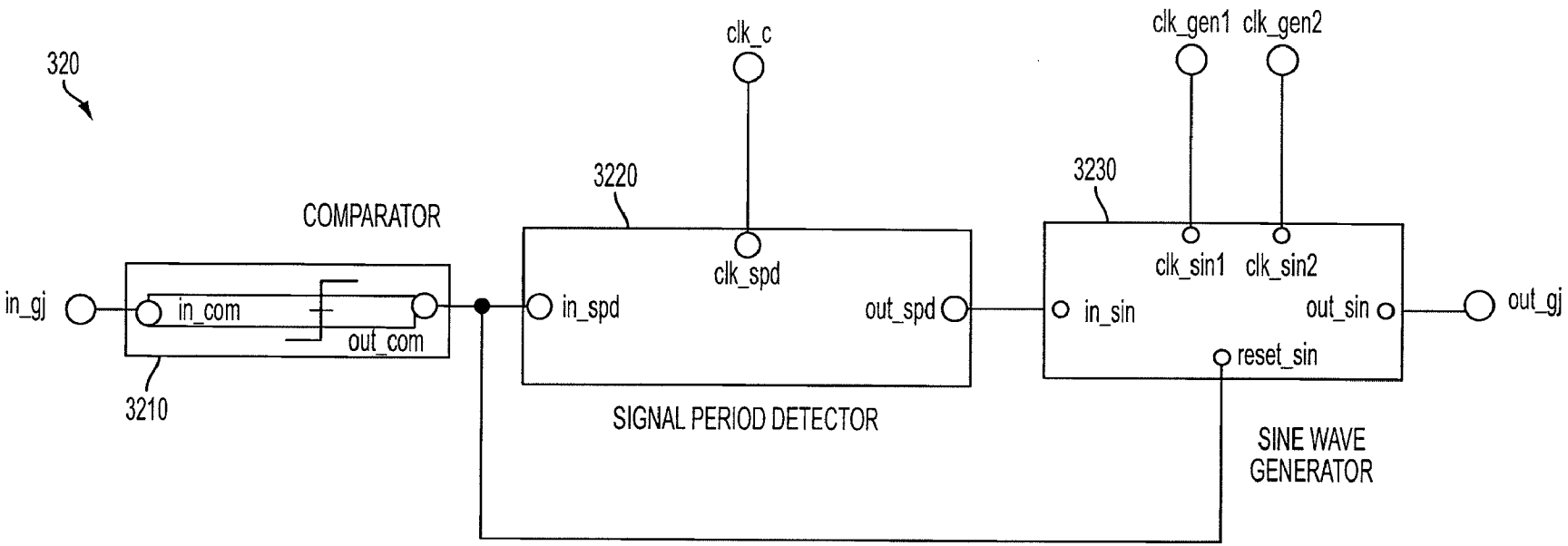
FIG. 4 is a block diagram illustrating a configuration of the jammer generator according to the first exemplary embodiment of the present invention.

FIG. 4 is a block diagram illustrating a configuration of the jammer generator according to the first exemplary embodiment of the present invention.

The jammer generator 320 may include a comparator 3210, a signal period detector 3220 and a sine-wave generator 3230, and has a differential input terminal (in_gj), a differential output terminal (out_gj), and external clock terminals {clk_c, clk_gen1, clk_gen2).

The comparator 3210 has a differential input terminal (in_com) and an output terminal (out_com). The signal period detector 3220 has an input terminal (in_spd), an output terminal (out_spd) and an external clock terminal (clk_spd). The sine-wave generator 3230 has an input terminal (in_sin), a differential output terminal (out_sin), a reset terminal (reset_sin) and two external clock terminals (clk_sin1, clk_sin2). Input terminal in_gj of the jammer generator 320 is internally connected to input terminal in_com of the comparator 3210. Output terminal out_com of the comparator 3210 is connected to input terminal in_spd of the signal period detector 3220 and reset_sin of the sine wave generator. Output terminal out_spd of the signal period detector 3220 is connected to input terminal in_sin of the sine-wave generator 3230. Output terminal out_gj, and clock terminals clk_c, clk_gen1 and clk_gen2 of the jammer generator 320 are internally connected to output terminal out_sin of the sine wave generator 3230, clock terminal clk_psd of the signal period detector 3220, and clock terminals clk_sin1, and clk_sin2 of the sine wave generator 3230, respectively.

The configuration and operation of the respective circuit blocks are described as follows.

Figure 5:
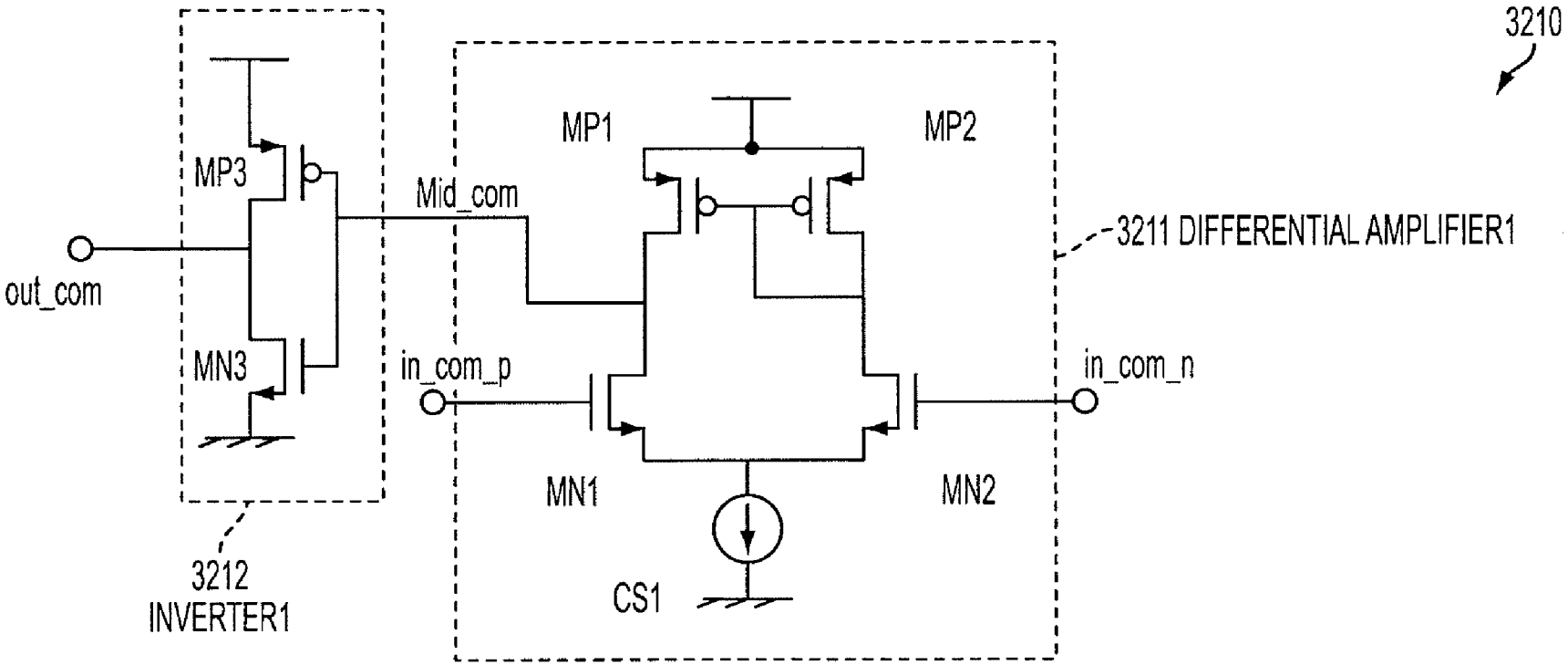
FIG. 5 is a circuit diagram of a comparator according to the first exemplary embodiment of the present invention.

FIG. 5 is a circuit diagram of a comparator according to the first exemplary embodiments of the present invention. The comparator 3210 outputs a high logic signal when the differential input voltage is greater than zero and a low logic signal when the differential input voltage is less than or equal to zero. The comparator 3210 may include a differential amplifier1 3211 and an inverting circuit inverter1 3212. The differential amplifier1 3211 may include two N-type MOSFETs (MN1 and MN2), two P type MOSFET (MP1, MP2) and a current source CS1. MN1 and MN2 are input transistors whose gate terminals are internally connected to the differential input terminals of the comparator 3210 (in_com_p, in_com_n). The drain and gate terminals of MP2 are connected with each other and to the drain terminal of MN2 and the gate terminal of MP1. The drain terminal of MP1 is connected to the drain terminal of MN1 and internally connected to an output terminal of differential amplifier1 3211 (mid_com). The current source CS1 is connected to the source terminals of MN1 and MN2. The sizes of MN1 and MN2 are identical. The sizes of MP1 and MP2 are also identical. Inverter1 3212 includes an N-type MOSFET (MN3) and a P-type MOSFET (MP3). The gate terminals of MN3 and MP3 are connected with each other and the drain terminals are also connected with each other.

The output voltage of the differential amplifier1 3211, Vout1, is expressed as in equation 4 below.

$$Vout1=-Av(Vin1-Vin2)+V0 \quad \text{Equation 4}$$

where Av represents the gain of differential amplifier1 3211, Vin1 and Vin2 are the voltage values at in_com_p and in_com_n, respectively, and V0 is a voltage value as Vout1 under the condition that Vin1 and Vin2 are at the same values.

Inverter1 3212 outputs a voltage value (Vgg) approximately equal to the ground voltage when its input voltage is higher than its threshold voltage (Vth_inv). On the other hand, inverter1 3212 outputs a voltage value (Vdd) approximately equal to a supply voltage when its input voltage is lower than or equal to Vth_inv. The sizes of MN3 and MP3 are determined so that Vth_inv is approximately equal to V0.

When the comparator 3210 receives a sinusoidal signal as a differential input signal, differential amplifier1 3211 amplifies it according to equation 4. The output voltage of differential amplifier1 3211, Vout1', is related to the differential input sinusoidal signal (A sin(ωt)) as in equation 5 below.

$$Vout1'=Av\,A\sin(\omega t)+V0 \quad \text{Equation 5}$$

Considering that inverter1 3212 outputs Vgg (or Vdd) for an input voltage larger (or smaller) than V0, inverter1 outputs a rectangular signal with period of $2\pi/\omega$ and duty cycle of 50% when receiving Vout1' as an input signal.

Figure 6:
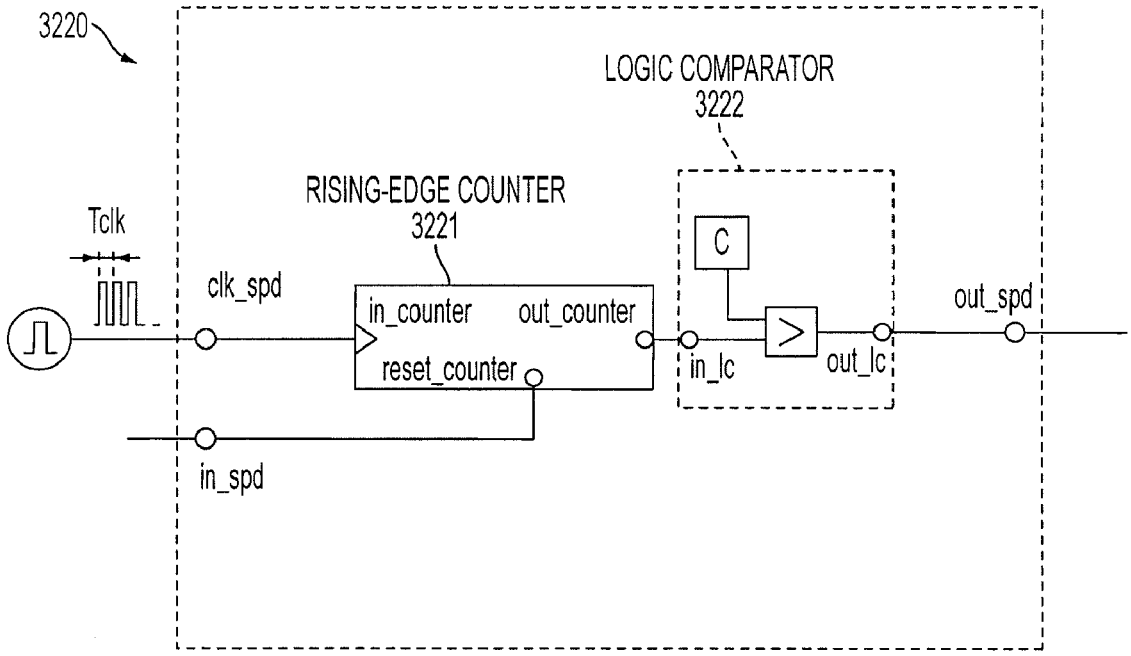
FIG. 6 is a block diagram illustrating a configuration of a signal period detector according to the first exemplary embodiment of the present invention.

FIG. 6 is a block diagram illustrating a configuration of a signal period detector according to the first exemplary embodiment of the present invention.

The signal period detector 3220 may include a rising edge counter 3221 and a logic comparator 3222. The rising edge counter 3221 has an input terminal (in_counter), an output terminal (out_counter) and a reset terminal (reset_counter). The logic comparator 3222 has an input terminal (in_lc) and an output terminal (out_lc).

An input terminal, in_spd, of the signal period detector 3220 is internally connected to the reset terminal, reset_counter, of the rising edge counter 3221. A clock terminal, clk_spd, of the signal period detector 3220 is internally connected to the input terminal, in_counter, of the rising edge counter 3221. An output terminal, out_spd, of the signal period detector 3220 is internally connected to the output terminal, out_lc, of the logic comparator 3222. The output terminal, out_counter, of the rising edge counter 3221 is connected to the input terminal, in_lc, of the logic comparator 3222.

The rising edge counter 3221 outputs a logic value according to the counted number of rising edges at in_counter within two sequential rising edges at reset_counter. The logic comparator 3222 outputs a low logic value when a logic value at in_lc is larger than an internal preset logic value (c_logic), and outputs a high logic value when a logic value at in_lc is equal to or less than c_logic.

Figure 7:
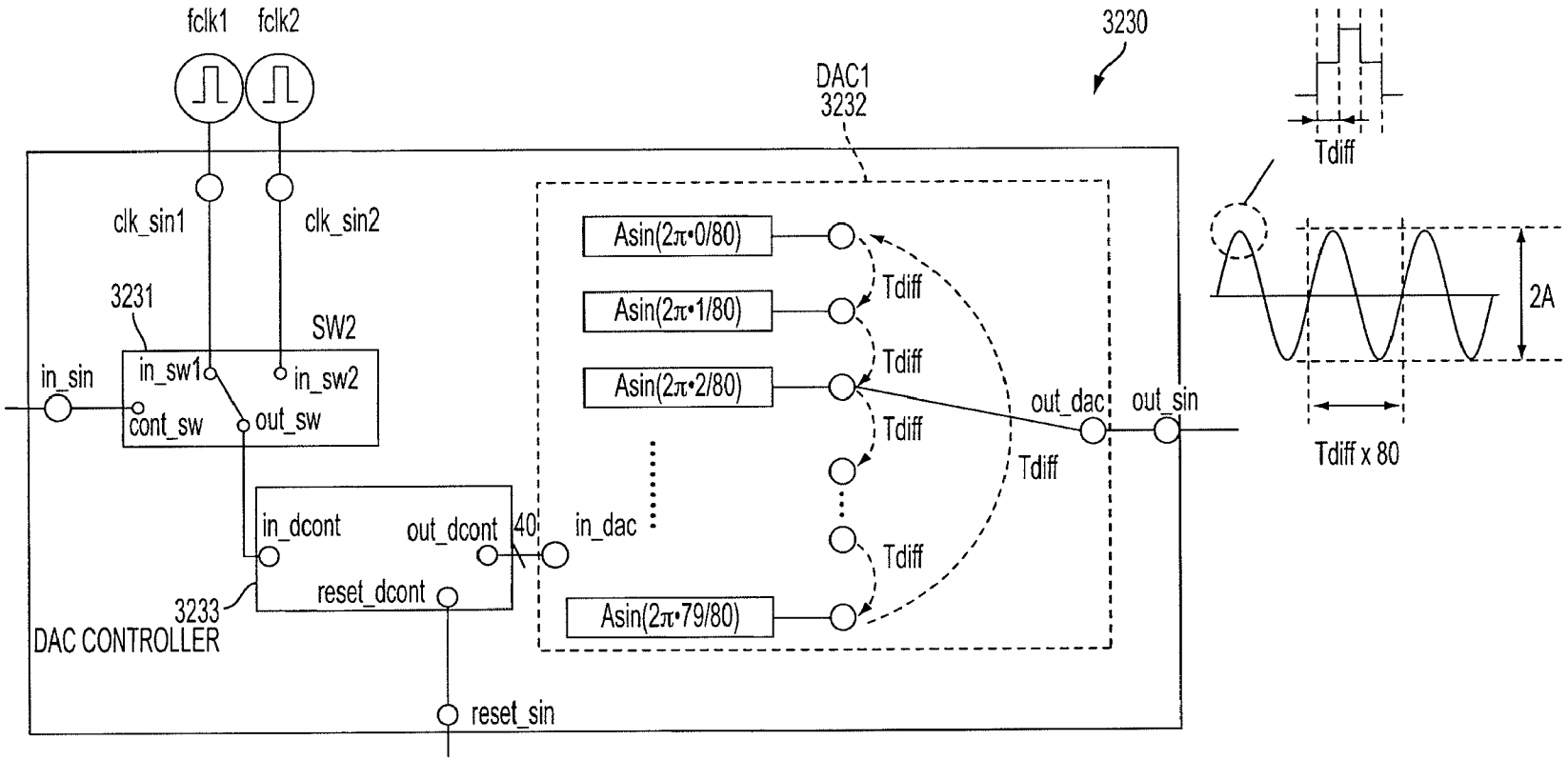
FIG. 7 is a block diagram illustrating a configuration and operation of a sine wave generator according to the first exemplary embodiment of the present invention.

FIG. 7 is a block diagram illustrating a configuration and operation of a sine wave generator according to the first exemplary embodiment of the present invention.

The sine wave generator 3230 may include a switch circuit (SW2) 3231, a digital-to-analog converter (DAC1) 3232 and a DAC-controller (DAC_cont) 3233.

The switch circuit SW2 3231 is similar to the switch circuit 3120 in VGA_cell 3101 illustrated in FIG. 11. The digital-to-analog converter DAC1 3232 has a 40-bit logic input terminal (in_dac) and a differential output terminal (out_dac). The DAC-controller 3233 has an input terminal (in_dcont), a reset terminal (reset_dcont), and a 40-bit logic output terminal (out_dcont). Terminals in_sin and out_sin, of the sine wave generator 3230 are internally connected to terminal cont_sw of SW2 3231 and terminal out_dac of DAC1 3232, respectively. Terminals clk_sin1 and clk_sin2 of the sine wave generator 3230 are internally connected to terminals in_sw1 and in_sw2 of SW2 3231, respectively. Terminal reset_sin of the sine wave generator 3230 is internally connected to reset_dcont of DAC_cont 3233. Terminal out_sw of SW2 3231 is connected to terminal in_dcont of DAC_cont 3233. Terminal out_dcont of DAC_cont 3233 is connected to terminal in_dac of DAC1 3232.

Figure 8:
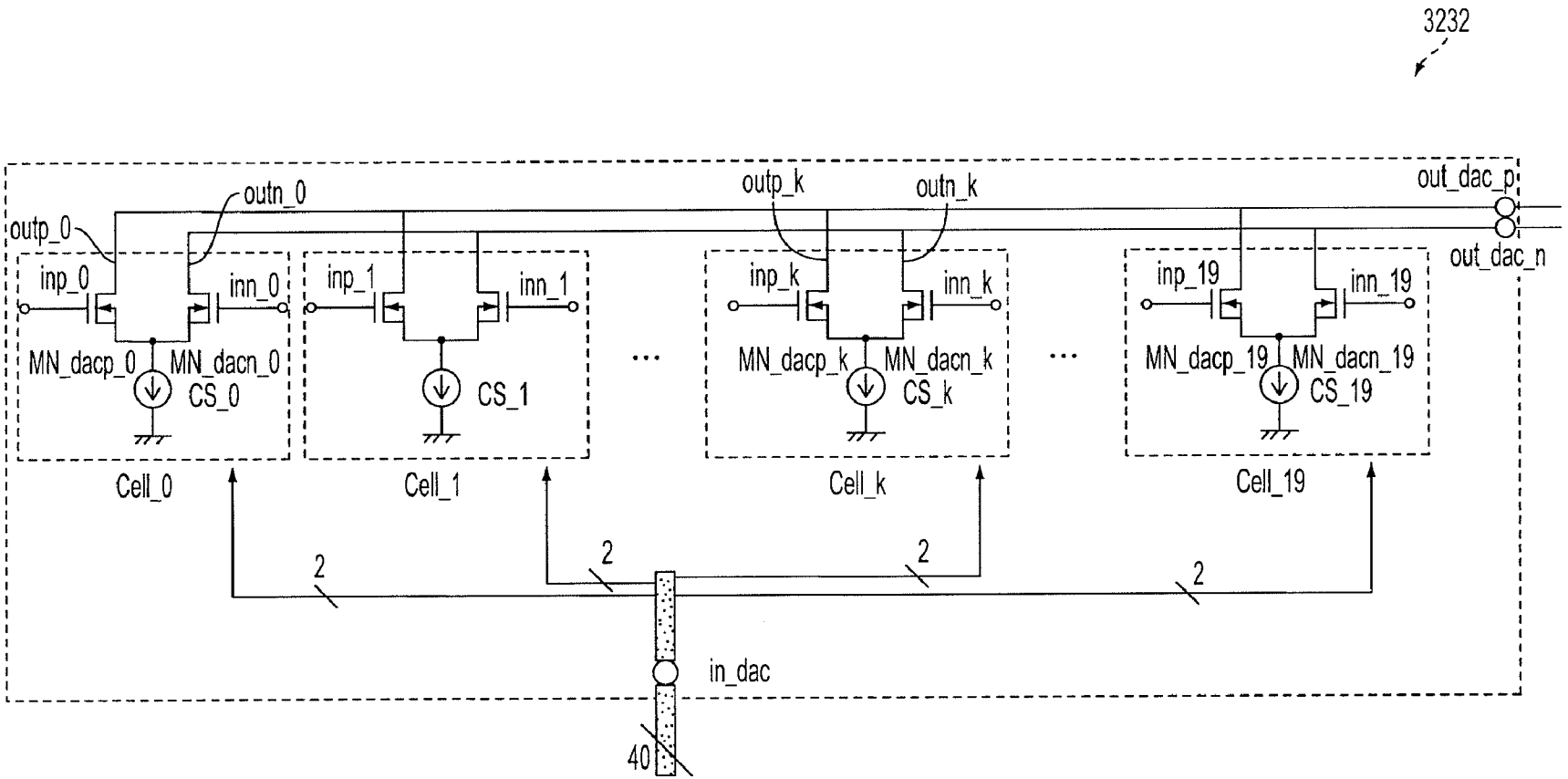
FIG. 8 is a circuit diagram illustrating a configuration of a digital-to-analog converter in the sine wave generator according to the first exemplary embodiment of the present invention.

FIG. 8 is a circuit diagram illustrating a configuration of a digital-to-analog converter in the sine wave generator according to the first exemplary embodiment of the present invention. Digital-to-analog converter DAC1 3232 may include twenty DAC cells (cell_0, cell_1 . . . cell_19). Cell_0 has two input terminals (inp_0, inn_0) and two output terminals (outp_0, outn_0) and may include two N-type MOSFETs (MN_dacp_0, MN_dacn_0) and a current source (CS_0). Inp_0 and inn_0 of cell_0 are internally connected to gate terminals of MN_dacp_0 and MN_dacn_0 respectively. Outp_0 and outn_0 are internally connected to drain terminals of MN_dacp_0 and MN_dacn_0, respectively. The source terminals of MN_dacp_0 and MN_dacn_0 are connected to each other and to CS_0.

The current value of CS_0 (I_CS_0) is expressed as below in equation 6.

$$I_CS_0 = A\sin(2\pi/80) \qquad \text{Equation 6}$$

where A is preset.

The other DAC cells that are cell_k (k=1, 2, . . . 19), have the same circuit topology as that of cell_0. Cell_k has two input terminals (inp_k, inn_k) and two output terminals (outp_k, outn_k) and may include two N-type MOSFETs (MN_dacp_k, MN_dacn_k) and a current source (CS_k). Inp_k and inn_k of cell_k are internally connected to gate terminals of MN_dacp_k and MN_dacn_k, respectively. Outp_k and outn_k of cell_k are internally connected to drain terminals of MN_dacp_k and MN_dacn_k, respectively. The source terminals of MN_dacp_k and MN_dacn_k are connected to each other and to CS_k.

The current value of CS_k (I_CS_k) is expressed as below in equation 7.

$$I_CS_k = A\sin(2\pi(k+1)/80) - [I_CS_(k-1) + I_CS_(k-2) + \ldots + I_CS_0](1 \leqq k \leqq 19) \qquad \text{Equation 7}$$

where A is preset.

When both inp_k and inn_k receive a high logic value, MN_dacp_k and MN_dacn_k turn on, which makes cell_k output a current I_CS_k, with half of the current from outp_k and half of the current from outn_k. Therefore, a differential output current from cell_k is equal to zero. When inp_k (or inn_k) receives a low logic value and inn_k (or inp_k) receives a high logic value, a differential output current from cell_k is equal to I_CS_k (or −I_CS_k).

The differential output terminals (out_dac_p, out_dac_n) of DAC1 3232 are internally connected to the output terminals outp_k and outn_k in in all of cell_k (k=0, 1 . . . 19), respectively.

The differential output current from DAC1 3232 is equal to the sum of differential output currents form all of DAC cells, that is cell_k (k=0, 1, 2 . . . 19). DAC1 3232 can output a differential current, I_dac, expressed as below in equation 8 by varying a DAC code given to in_dac of DAC1 3232.

$$I_\text{dac} = A\sin(2\pi j/80), \text{ where } (0 \leqq j \leqq 79) \qquad \text{Equation 8}$$

Figures 9, 10:
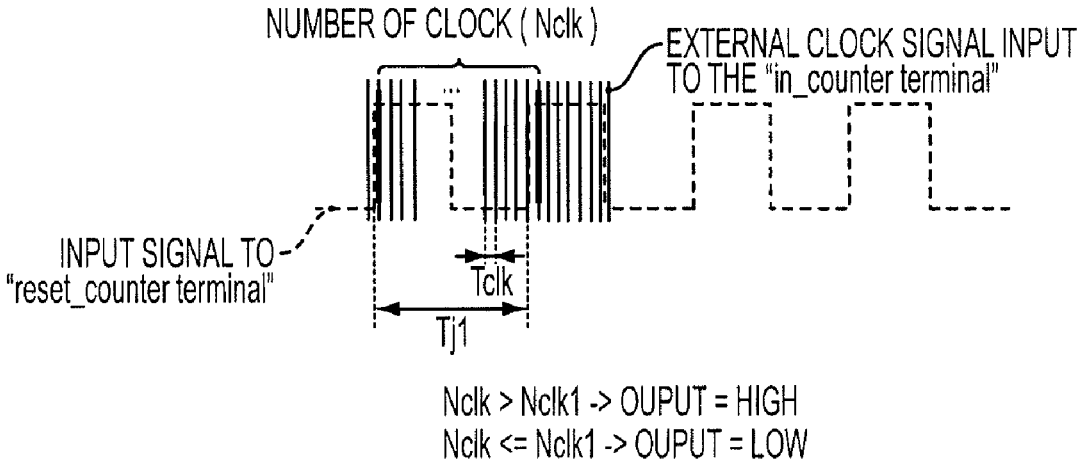
FIG. 9 is a code table showing a relationship between the differential output currents and digital-to-analog converter (DAC) codes according to the first exemplary embodiment of the present invention.
FIG. 10 is a diagram illustrating operation of a signal period detector according to the first exemplary embodiment of the present invention.

FIG. 9 is a code table showing a relationship between the differential output currents, I_dac, and DAC codes according to the first exemplary embodiment of the present invention.

When reset_dcont of the DAC controller 3233 receives a rising edge, the DAC controller 3233 outputs the DAC code to in_dac of DAC1 3232 so that the differential output current of DAC1 3232 is equal to I_dac with j=0 in the equation 9. And, when in_dcont of DAC controller 3233 receives a rising edge, DAC controller 3233 updates the DAC code so that the differential output current of DAC1 3232 changes in ascending order of j in equation 8. When j reaches 79, the DAC code is updated for j of 0 as a next step.

Assuming that the duration time of rising edges at in_dcont of the DAC controller 3233 is Tdiff, DAC1 3232 can output a pseudo sine wave signal with a period of Tdiff times 80.

The practical operation of the sine wave generator 3230 is described as below with reference to FIG. 7.

Assume that clk_sin1 and clk_sin2 of the sine wave generator 3230 are connected to external clock sources with clock frequencies of Fclk1 and Fclk2, respectively. When in_sin of the sine wave generator 3230 receives a high logic value, the DAC controller 3233 updates the DAC code at a rate of Fclk1. Accordingly, DAC1 3232 outputs a pseudo sine wave signal with a period of 80/Fclk1. When in_sin of the sine wave generator 3230 receives a low logic value, the DAC controller 3233 updates the DAC code at a rate of Fclk2. Accordingly, DAC1 3232 outputs a pseudo sine wave signal with a period of 80/Fclk2.

A phase of the pseudo sine wave signal is reset to zero when reset_sin of the sine wave generator 3230 receives a rising edge.

Figure 13:
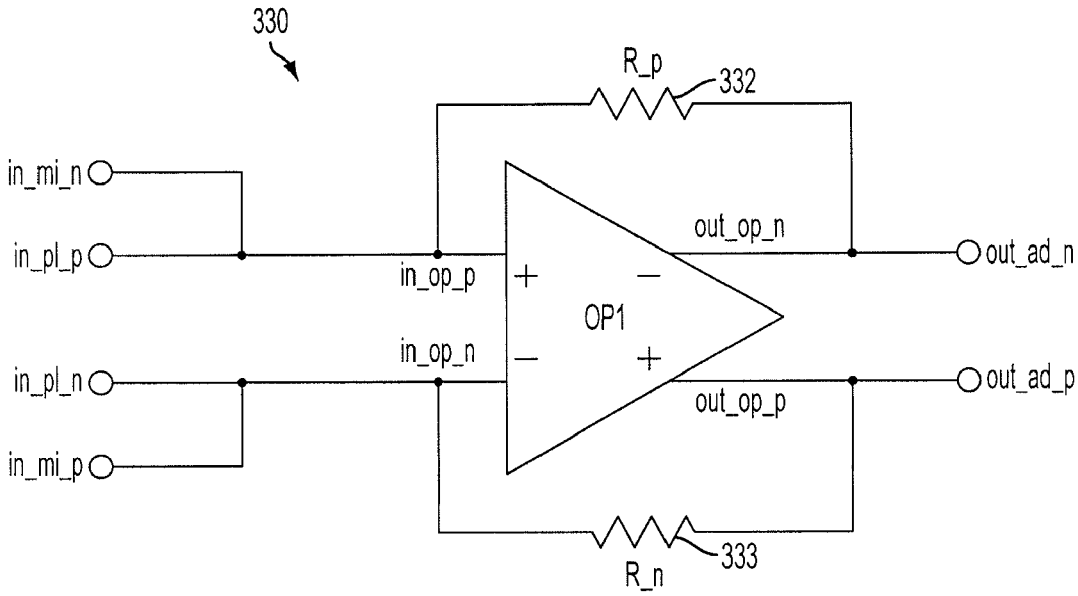
FIG. 13 is a circuit diagram illustrating a configuration of an adder according to the first exemplary embodiment of the present invention.

FIG. 13 is a circuit diagram illustrating a configuration of an adder according to the first exemplary embodiment of the present invention.

The adder 330 has positive (+) differential input terminals in_p1_p and in_p1_n, negative (−) differential input terminals in_mi_p and in_mi_n, and differential output terminals out_ad_p and out_ad_n, and may include an operational amplifier (OP1) and two resistors, R_p and R_n. OP1 has differential input terminals in_op_p and in_op_n, and differential output terminals out_op_p and out_op_n. R_p and R_n may have the same resistance value, R_load.

The positive and negative differential input terminals of the adder 330 are internally connected to the differential input terminal of OP1. Positive differential input terminal in_p1_p and negative differential input terminal in_mi_n of the adder 330 are connected to the positive differential input terminal in_op_p of OP1, and positive differential input terminal in_p1_n and negative differential input terminal in_mi_p of the adder 330 are connected to the negative differential input terminal in_op_n of OP1. One terminal of R_p is connected to in_op_p and the other terminal of R_p is connected to out_ op_n of OP1. One terminal of R_n is connected to in_op_n and the other terminal of R_n is connected to out_op_p of OP1.

Assume that a differential voltage gain (Avop) of OP1 is much larger than one (Avop>>1) and an input impedance of OP1 is also much larger than R_load.

A differential output voltage of OP1, Vout_op, is expressed as equation 9 below.

$$Vout_op=(Avop)(Vin_op), \quad \text{Equation 9}$$

where Vin_op is a differential input voltage of OP1.

Vout_op is also expressed as below in equation 10 by Ohm's law.

$$Vout_op=Vin_op-R(Ipl-Imi) \quad \text{Equation 10}$$

where I_p1 and I_mi are, respectively, differential input currents from the positive differential input terminal and the negative differential input terminal of OP1.

From equations 9 and 10, Vout_op is calculated as in equation 11 below.

$$Vout_op=-Avop/(Avop-1)R(Ipl-Imi) \quad \text{Equation 11}$$

Considering that Avop is much larger than one, Vout_op is approximately expressed as in equation 12 below.

$$Vout_op=-R(Ipl-Imi) \quad \text{Equation 12}$$

Equation 12 indicates that the adder 330 outputs a differential voltage proportional to the difference between currents input to the positive differential input terminal and the negative differential input terminal of OP1.

The operation of this exemplary embodiment is described as follows.

As described before, many channel signals (Smulti) may be input to this exemplary embodiment simultaneously. Only one channel signal in Smulti is a desired signal (S1) and the other channel signals are all considered jammers. Here, we assume that the power of a specific jammer (J1) is higher by Pj1 dB than the summation of signal powers of any other channel signal including S1. We also assume that the modulation type of J1 is frequency-shift-keying (FSK) and its modulation index, frequency deviation, and carrier frequency are known as m, Fdiv (Hz), Fc (Hz) respectively. The ratio of Fc to Fdiv is defined as Fratio. A data rate, DRj1 is equal to Fdiv/m.

In addition, we assume that Pj1 is equal to 40 dB and J1 has a frequency of Fc+Fdiv/2 for representing the symbol "1" and a frequency of Fc−Fdiv/2 for representing the symbol "0", and Fratio is larger than ten.

Referring to FIG. 3, Smulti is processed in VGA 310 for amplitude adjustment. The VGA controller 340 identifies the amplitude of the input signal and controls the VGA 310 gain so that the amplitude of the VGA output current is approximately equal to A, i.e., the amplitude of the pseudo sine-wave current output from the jammer generator, in equation 8.

The amplitude of J1 included in the VGA output current and the jammer generator's output current matches within an accuracy of about 1% since the power of J1 is 40 dB larger than the summation of the signal powers of any other channel signal. Accordingly, the amplitude of J1 included in the VGA output current is approximately equal to that of the pseudo sine wave signal current from the jammer generator 320.

The VGA output signal is transferred to the jammer generator 320. The input signal of the jammer generator 320 is internally transferred to the comparator 3210 (see FIG. 4).

The comparator 3210 outputs a high logic value for its input voltage greater than zero and a low logic value for its input voltage less than or equal to zero.

The input signal of the jammer generator (Vin_jam) can be expressed as in equation 13 below since a power of J1 is 40 dB larger than the summation of the other channel.

$$Vin_jamgen=B\sin(2\pi/Tjl\ t)+Vother, \quad \text{Equation 13}$$

where Vother is expressed by equation 14.

$$|Vother|<B\ 10\hat{}(-Pj1/20)=0.01\ B, \quad \text{Equation 14}$$

where B and Tj1 represent the amplitude and period of J1 included in the input signal of the jammer generator 320, respectively.

The time, T0, at which Vin_jamgen crosses a zero point in direction from negative to positive, is expressed as in equation 15 below.

$$T0=Tjl_only+Tother, \quad \text{Equation 15}$$

where Tj1_only is expressed by equation 16.

$$Tjl_only=k(Tjl),\ \text{where}\ k=0,1,2, \quad \text{Equation 16}$$

and the Tother is expressed by equation 17.

$$|Tother|<(Tjl/2\pi)\text{Arc}\sin(10\hat{}(-Pj1/20))=0.01\ Tjl/2\pi=0.0016\ Tjl \quad \text{Equation 17}$$

where Tj1_only represents the time at which the phase of J1 is equal to zero. Tother represents the degree by which the other channel signals affect Tj1.

Equations 15, 16, and 17 indicate that T0 matches with Tj1_only within an accuracy of about 0.16%.

This also indicates that the period of the output signal of the comparator matches with the period of J1 within an accuracy of about 0.16%.

The output signal of the comparator 3210 is transferred to the signal period detector 3220 in the jammer generator 320.

The operation of the signal period detector 3220 is described below with reference to FIG. 6 and FIG. 10.

Referring to FIG. 6, reset_counter of the rising edge counter 3221 in the signal period detector 3220 receives the input signal of the signal period detector 3220. In_counter of the rising edge counter 3221 receives a clock signal of an external clock source with the clock rate of Tclk.

When the output signal of the comparator 3210 is input to the signal period detector 3220, a logic value (Nclk) output from out_counter of the rising edge counter 3221 is determined as follows.

When the symbol of J1 is "1":

Tj1 equals to 1/(Fc+Fdiv/2)

The duration of two sequential rising edges at reset_counter of the rising edge counter 3221 is 1/(Fc+Fdiv/2) as shown in FIG. 10. Then Nclk is determined as in equation 18 below.

$$Nclk=Nclk1, \quad \text{Equation 18}$$

where Nclk1 is an integer less than or equal to 1/(Fc+Fdiv/2)/Tclk. When the symbol of J1 is "0":

Tj1 equals to 1/(Fc−Fdiv/2)

The duration of two sequential rising edges at reset_counter of the rising edge counter 3221 is 1/(Fc-Fdiv/2) as shown in FIG. 10. Then Nclk is determined as in equation 19 below.

$$Nclk=Nclk2, \quad \text{Equation 19}$$

where Nclk2 is a maximum integer not more than 1/(Fc−Fdiv/2)/Tclk. Here, Tclk is set so that a difference between Nclk1 and Nclk2 is more than 1. It is noted that Nclk2 is always larger than Nclk1.

The output signal of the rising edge counter 3221 is transferred to the logic comparator 3222. By setting the internal preset logic value, c_logic, of the logic comparator 3222 to a value within Nclk1 and Nclk2, the logic comparator 3222 outputs a high logic value for its input of Nclk1 and a low logic value for its input of Nclk2.

Accordingly, the signal period detector outputs a high logic value for the J1 symbol of "1" and a low logic value for the J1 symbol of "0".

The output signal of the signal period detector is transferred to in_sin of the sine wave generator 3230. Reset_sin of the sine wave generator 3230 receives the output signal of the logic comparator 3210. Clk_sin 1 of the sine wave generator 3230 receives the clock signal from an external clock source with a frequency of (Fc+Fdiv/2)×80. Clk_sin2 of the sine wave generator 3230 receives the clock signal from an external clock source with a frequency of (Fc−Fdiv/2)×80.

When the J1 symbol is "1", in_sin of the sine wave generator 3230 receives a high logic value from the signal period detector 3220. Therefore, the sine wave generator 3230 outputs a pseudo sine wave signal with a frequency of Fc+Fdiv/2.

When reset_sin of the sine wave generator 3230 receives the rising edge, the phase of the pseudo sine wave signal is reset to zero. The time at which a rising edge is received by reset_sin of the sine wave generator 3230 is T0 in equation 15. Accordingly, the phase of the pseudo sine wave signal matches well with that of J1.

When the J1 symbol is "0", the sine wave generator 3230 outputs a pseudo sine wave signal with a frequency of Fc−Fdiv/2. The phase of the pseudo sine wave signal also matches well with that of J1.

The above description indicates that the jammer generator 320 outputs a pseudo sine wave signal with the same frequency and phase as that of J1.

In addition, the amplitude of J1 at the VGA output signal is approximately equal to that of the jammer generator output.

Therefore, the amplitude, frequency and phase of the jammer generator output signal are approximately equal to those of J1 in the VGA output signal.

When the two differential input terminals of the adder 330 receive the VGA output signal and the jammer generator output signal, respectively, the adder 330 outputs a differential voltage proportional to the difference between the VGA output signal and the jammer generator output signal.

Given that the amplitude, frequency and phase of the jammer generator output signal are approximately equal to those of J1 in the VGA output signal, the power of J1 is greatly reduced at the adder output.

Therefore, this exemplary embodiment can improve the SNR by suppressing a jammer, resulting in the mitigation of the requirement for increased ADC resolution.

Second Exemplary Embodiment

Figure 14:
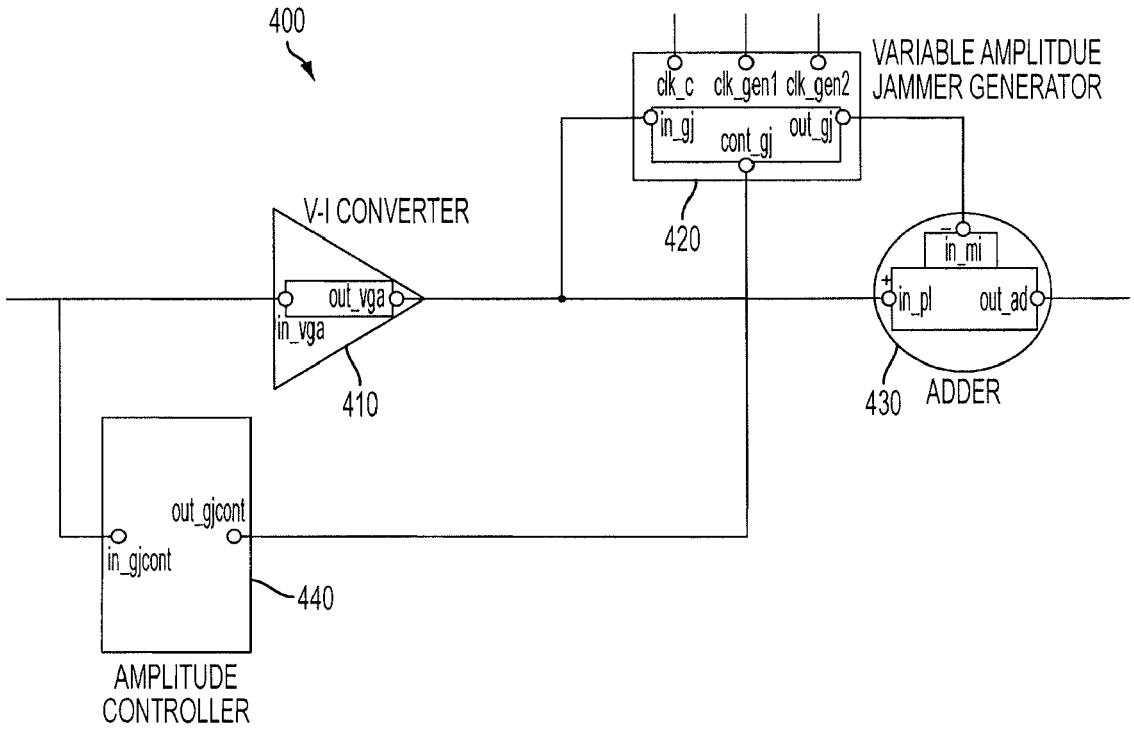
FIG. 14 is a block diagram illustrating a filtering circuit with a variable amplitude jammer generator according to a second exemplary embodiment of the present invention.

FIG. 14 is a block diagram illustrating a filtering circuit with a variable amplitude jammer generator according to a second exemplary embodiment of the present invention.

The filtering circuit 400 of the second exemplary embodiment may include a voltage-current converter (VIC) 410, a variable amplitude jammer generator (VAJG) 420, an adder 430, and an amplitude controller 440.

The VIC 410 converts a voltage signal into a current signal with a preset conversion gain. The VAJG 420 identifies the frequency and phase of its input signal and then outputs a sinusoidal current with the same frequency and phase as the input signal. In addition, the amplitude of the sinusoidal current output from VAJG 420 may be controlled by an external control signal. The amplitude controller 440 adjusts the amplitude of the VAJG output current so that the amplitude of the output current of the VAJG 420 is equal to that of the VIC output current. The adder 430 may be the same circuit as the adder 330 described in the first exemplary embodiment (see FIG. 3).

The input terminal of the filtering circuit 400 is internally connected to the input terminals of the VIC 410 and the amplitude-controller 440. The output terminal of the VIC 410 is connected to the input terminal of the VAJG 420 and the positive terminal of the adder 430. The output terminal of the amplitude-controller 440 is connected to the control terminal of the VAJG 420. The output terminal of the VAJG 420 is connected to the negative terminal of the adder 430. The output terminal of this exemplary embodiment is internally connected to the output terminal of the adder 430.

Here, we assume that Smulti, described in the first exemplary embodiment, is input to the filtering circuit 400 and the power of a specific Jammer (J1) is higher by Pj1 dB than the summation of the powers of any other channel signal including the desired signal (S1). And we also assume that the modulation type of J1 is frequency-shift-keying (FSK) and its modulation index, frequency deviation, and carrier frequency are known as m, Fdiv (Hz), Fc (Hz), respectively.

Input signal Smulti for this embodiment is processed in the VIC 410 so as to convert the voltage signal to a current signal, and the current signal is transferred to the input terminal of the VAJG 420 and the positive terminal of the adder 430. The VAJG 420 identifies the information of the frequency and phase of J1 in Smulti and outputs a sinusoidal current with the same frequency and phase as J1. This sinusoidal current is input to the negative terminal of the adder 430. The amplitude-controller 440 identifies the amplitude of J1 in Smulti and controls the amplitude of the sinusoidal current output from the VAJG 420 so that the amplitude of the VAJG's output sinusoidal current may agree with that of VIC output current. Accordingly, J1 at the positive terminal of the adder 430 agrees well with the sinusoidal wave at the negative terminal of the adder 430 in amplitude, frequency and phase. Therefore, only J1 in Smulti may be strongly suppressed at the output terminal of the adder 430.

The configuration and operation of the respective circuit blocks except for the adder 440, since it may be the same with that in the first exemplary embodiment, are described as follows.

Figure 15:
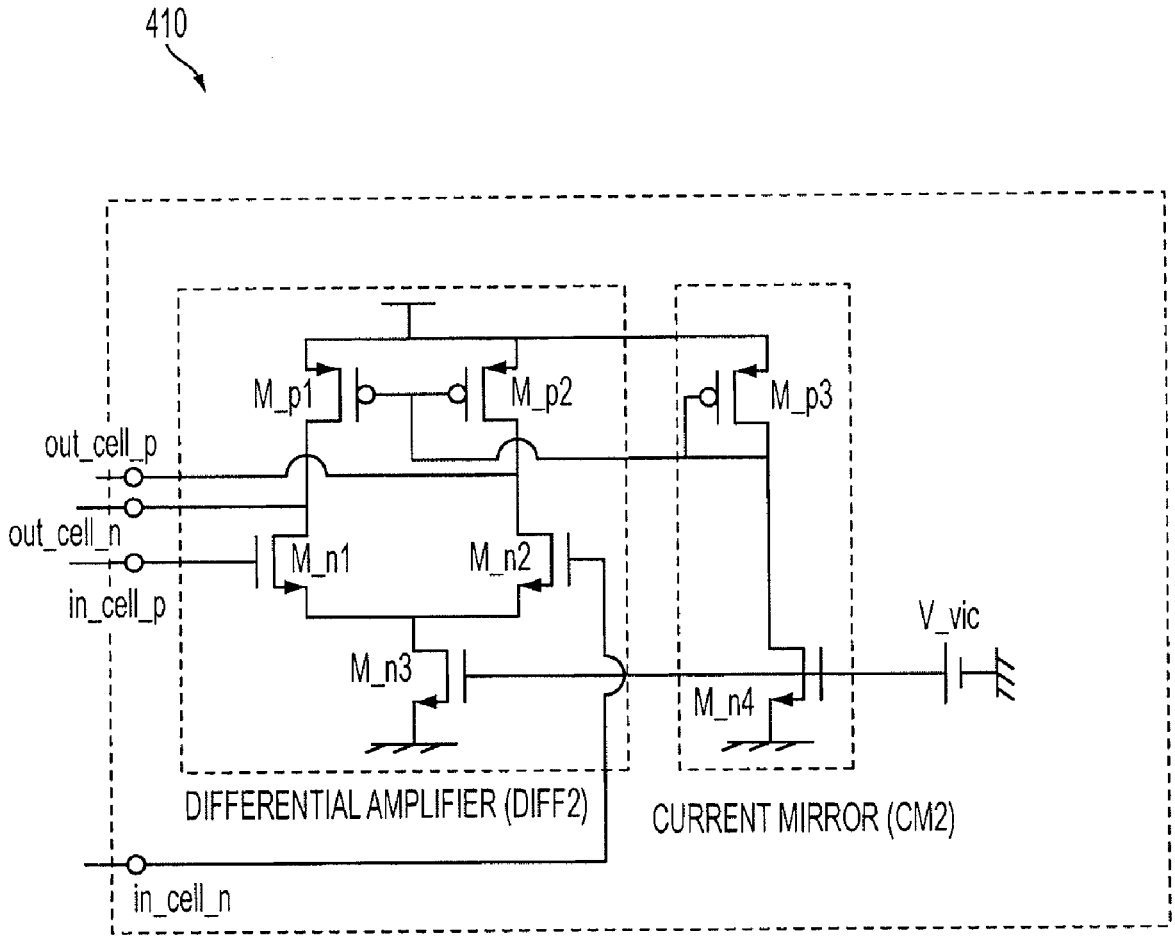
FIG. 15 is a circuit diagram illustrating the configuration of a voltage-current converter (VIC) according to the second exemplary embodiment of the present invention.

FIG. 15 is a circuit diagram illustrating the configuration of a voltage-current converter (VIC) according to the second exemplary embodiment of the present invention.

The VIC 410 may include a differential amplifier (DIFF2) and a current mirror circuit (CM2). DIFF2 and CM2 may have the same configuration with DIFF1 and CM1 shown in FIG. 11.

The circuit elements in VIC 410 which are the same with those shown in FIG. 11 have the same notation with those shown in FIG. 11.

Referring again to FIG. 15, gate terminals of M_n3 and M_n4 are connected to an external voltage source (V_vic).

When a differential input voltage, V_invic, is input, a differential output current from VIC 410, I_outvic, is expressed by equation 20.

$$Iout_{vic}=(gm_vic)(V_in_{vic}) \quad \text{Equation 20}$$

where gm_vic is the gm value of M_n1, or M_n2.

Figure 16:
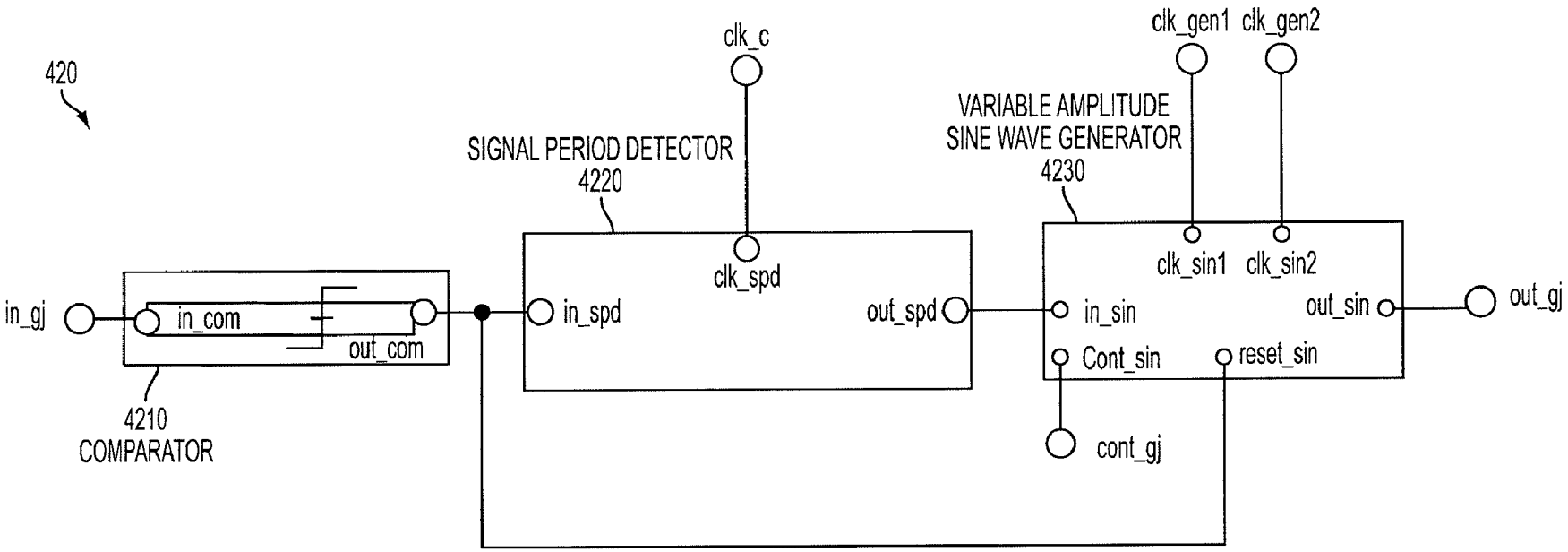
FIG. 16 is a block diagram showing a configuration of a variable amplitude jammer generator VAJG according to the second exemplary embodiment of the present invention.

FIG. 16 is a block diagram showing a configuration of a VAJG according to the second exemplary embodiment of the present invention.

The VAJG 420 may include a comparator 4210, a signal period detector 4220 and an amplitude variable sine-wave generator 4230. The VAJG 420 corresponds to the jammer generator 320 of the first exemplary embodiment in which sine-wave generator 3230 is replaced by the variable amplitude sine-wave generator 4230. The variable amplitude sine-wave generator 4230 corresponds to the sine wave generator 3230 of the first exemplary embodiment whose output amplitude can be controllable. The VAJG 420 has a control terminal (cont_gj) for adjustment of the output current amplitude in addition to terminals which are included in the jammer generator 320 of the first exemplary embodiment.

Figure 17:
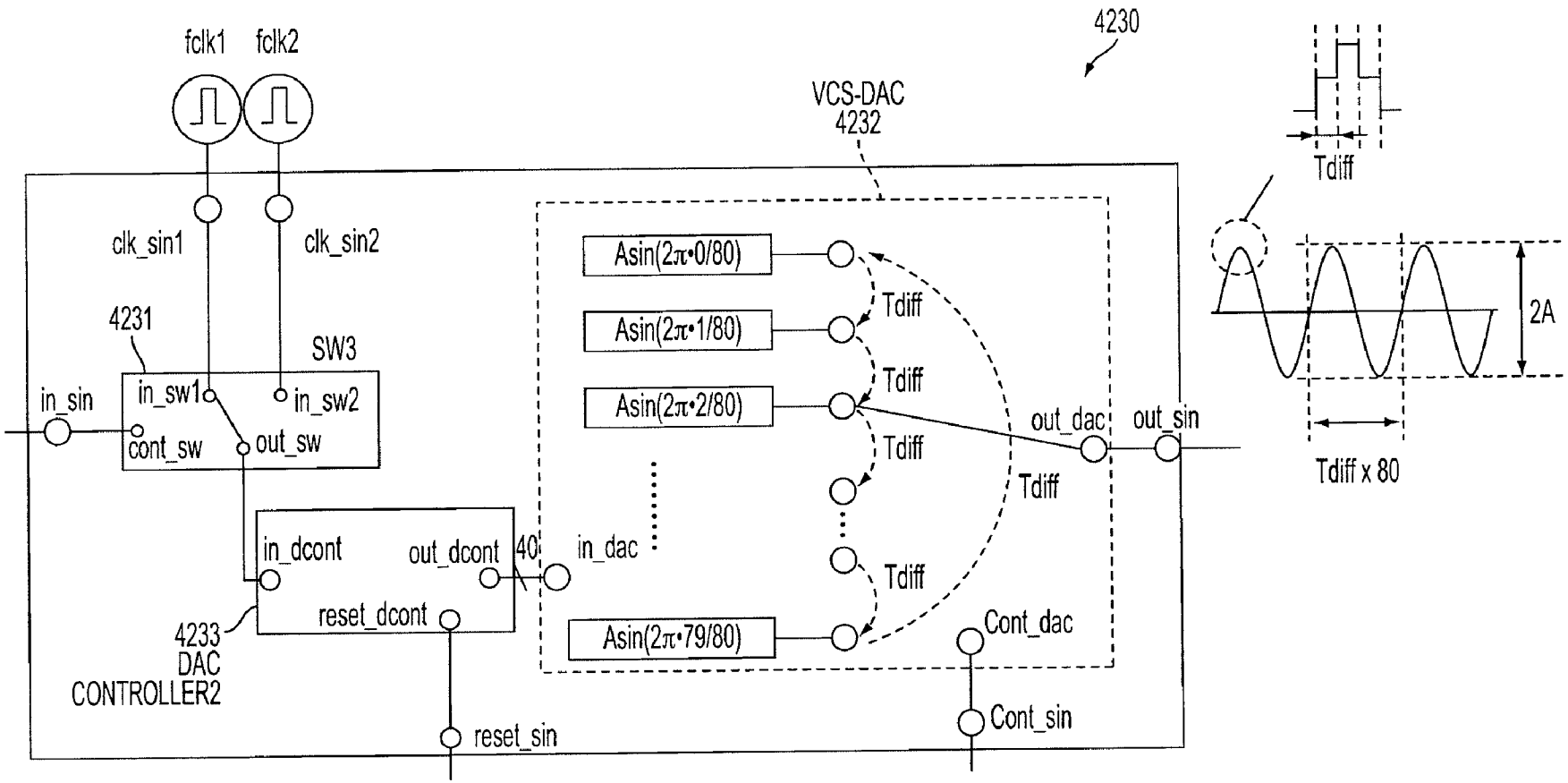
FIG. 17 is a block diagram illustrating a configuration and operation of a variable amplitude sine wave generator according to the second exemplary embodiment of the present invention.

FIG. 17 is a block diagram illustrating a configuration and operation of a variable amplitude sine wave generator according to the second exemplary embodiment of the present invention. The variable amplitude sine wave generator 4230 may include a switch circuit SW3 4231, a variable current source digital-to-analog converter VCS-DAC 4232 and a DAC-controller DAC_cont2 4233. SW3 4231 and DAC_cont2 4233 have the same configuration as SW2 3231 and DAC_cont1 3233 shown in FIG. 7. The variable amplitude sine wave generator 4230 corresponds to the sine wave generator 3230 of the first exemplary embodiment in which DAC1 3232 is replaced by a VCS-DAC 4232. The amplitude variable sine wave generator 4230 has a control terminal (cont_sin) for adjustment of the output current amplitude, in addition to the terminals which are included in the sine wave generator 3230 of the first exemplary embodiment.

Figure 18:
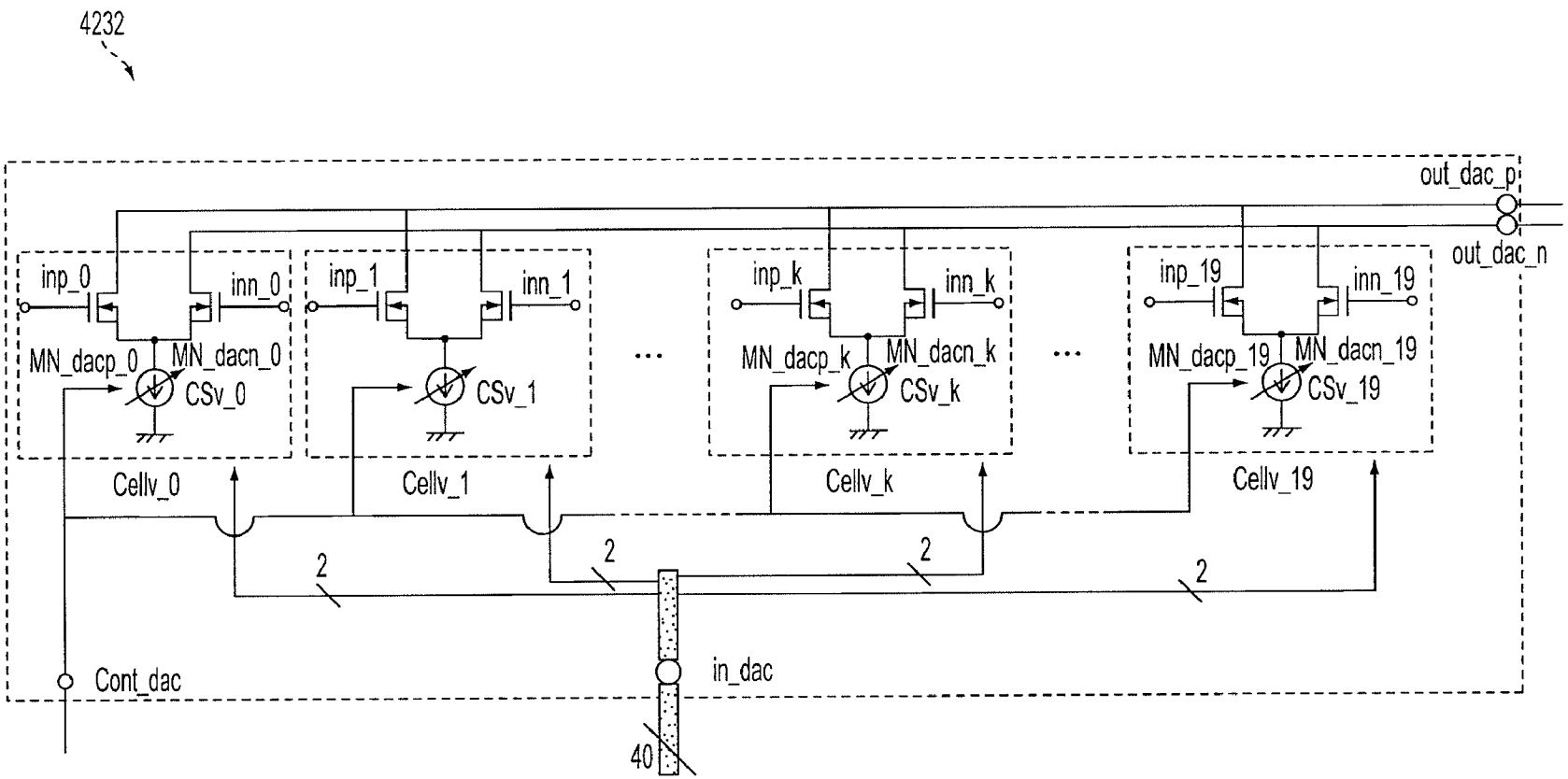
FIG. 18 is a circuit diagram showing a configuration of a variable current source digital-to-analog converter (VCS-DAC) according to the second exemplary embodiment of the present invention.

FIG. 18 is a circuit diagram illustrating a configuration of a VCS-DAC according to the second exemplary embodiment of the present invention. The circuit elements and nodes in the VCS-DAC 4232 which are the same as those shown in FIG. 8 have the same notation as those shown in FIG. 8. VCS-DAC 4232 may include twenty VCS-DAC cells (cellv_0, cellv_1 . . . cellv_19). The cellv_k (k=0,1,2 . . . 19) respectively corresponds to a cell_k (k=0,1,2 . . . 9) in DAC1 3232 (see FIG. 8) in which a current source CS_k (k=0,1,2 . . . 19) is replaced with a variable current source CSv_k (k=0,1,2 . . . 19). The VCS-DAC 4232 has the control terminal (cont_dac) to control a current value of CSv_k (k=0,1,2 . . . 19) in addition to the terminals which are also included in DAC1 3232. All current values of CSv_0, CSv_1 . . . and CSv_19 are uniformly changeable according to a control signal applied to cont_dac of VCS-DAC 4232.

The output current, I_CSv_k, of the variable current source CSv_k is expressed as equations 21 and 22 below.

$$I_CSv_0=(Avcs_dac)\sin(2\pi/80),\ \text{where } k=0 \qquad \text{Equation 21}$$

$$I_CSv_k=(Avcs_dac)\sin(2\pi(k+1)/80)-[I_CSv_(k-1)+I_CSv_(k-2)+\ldots+I_CS_0],\ \text{where } 1\leqq k\leqq 19 \qquad \text{Equation 22}$$

where Avcs_dac is preset and changeable by a control signal applied to cont_dac.

The DAC controller2 4233 controls the output current of VCS-DAC 4232, I_dacv, as expressed in equation 23 below by using the control table shown in FIG. 9.

$$I_dacv=(Avcs_dac)\sin(2\pi j/80),\ \text{where } (0\leqq j\leqq 79) \qquad \text{Equation 23}$$

Cont_sin of the variable amplitude sine-wave generator 4230 is internally connected to cont_dac of VCS-DAC 4232. Moreover, Cont_gj of VAJG 420 is internally connected to cont_sine of the amplitude variable sine-wave generator 4230. Therefore Avcs_dac in equation 23 can be controlled by the control signal given to cont_gj of VAJG 420. Accordingly, the amplitude of pseudo sine wave signal from the VAJG 420 can be controlled by the control signal applied to cont_gj of the VAJG 420.

Figure 19:
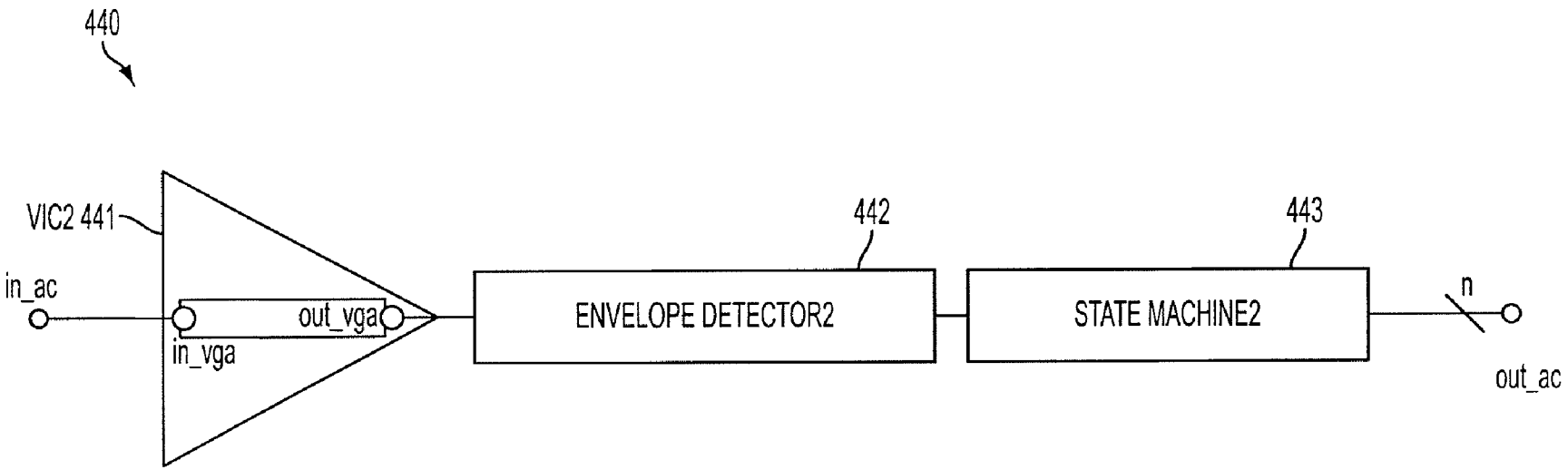
FIG. 19 is a block diagram of an amplitude controller according to the second exemplary embodiment of the present invention.

FIG. 19 is a block diagram of an amplitude controller according to the second exemplary embodiment of the present invention. The amplitude controller 440 may include a voltage-current converter VIC2 441, envelope detector EV2 442 and state machine ST2 443.

The amplitude controller 440 has a differential input terminal in_ac and an output terminal out_ac. VIC2 441 and EV2 442 may have the same configuration as VIC 410 shown in FIG. 15 and envelope detector 3404 shown in FIG. 12. In_ac and out_ac of the amplitude controller 440 are internally connected to the input terminal of VIC2 441 and the output terminal of ST2 443, respectively.

A voltage signal input to the amplitude controller 440 is converted to a current signal at VIC2 441 and the current signal is input to EV2 442. EV2 442 acquires amplitude information of the input signal and outputs a DC value corresponding to the amplitude information. The output DC value of the envelope detector 442 is input to ST2 443. ST2 443 outputs a control signal corresponding to the input value by referring to a lookup table so that the amplitude of the output signal of VAJG 420 is approximately the same as that of VIC2 441.

Here, VIC 410 and VIC2 441 have the same configuration and their input terminals are connected with each other. Therefore, the amplitude of the output current of VIC 410 is equal to that of VIC2 441. Accordingly, the amplitude of the output current of VIC 410 is also equal to that of VAJG 420.

The frequency and phase of VAJG output current is approximately equal to that of VIC 410.

Therefore, the amplitude, frequency and phase of the VAJG output signal are approximately equal to those of J1 in VIC output signal.

When the two differential input terminals of the adder 430 receive the VIC output signal and the VAJG output signal, respectively, the adder 430 outputs a differential voltage proportional to the difference between the VIC output signal and the VAJG output signal.

Given that the amplitude, frequency and phase of the VAJG output signal are approximately equal to the amplitude, frequency and phase of J1 in the VIC output signal, the power of J1 is greatly reduced at the adder 430 output.

Therefore, the second exemplary embodiment can improve the SNR by suppressing a jammer, resulting in the mitigation of the resolution requirement for the ADC.

Figure 20:
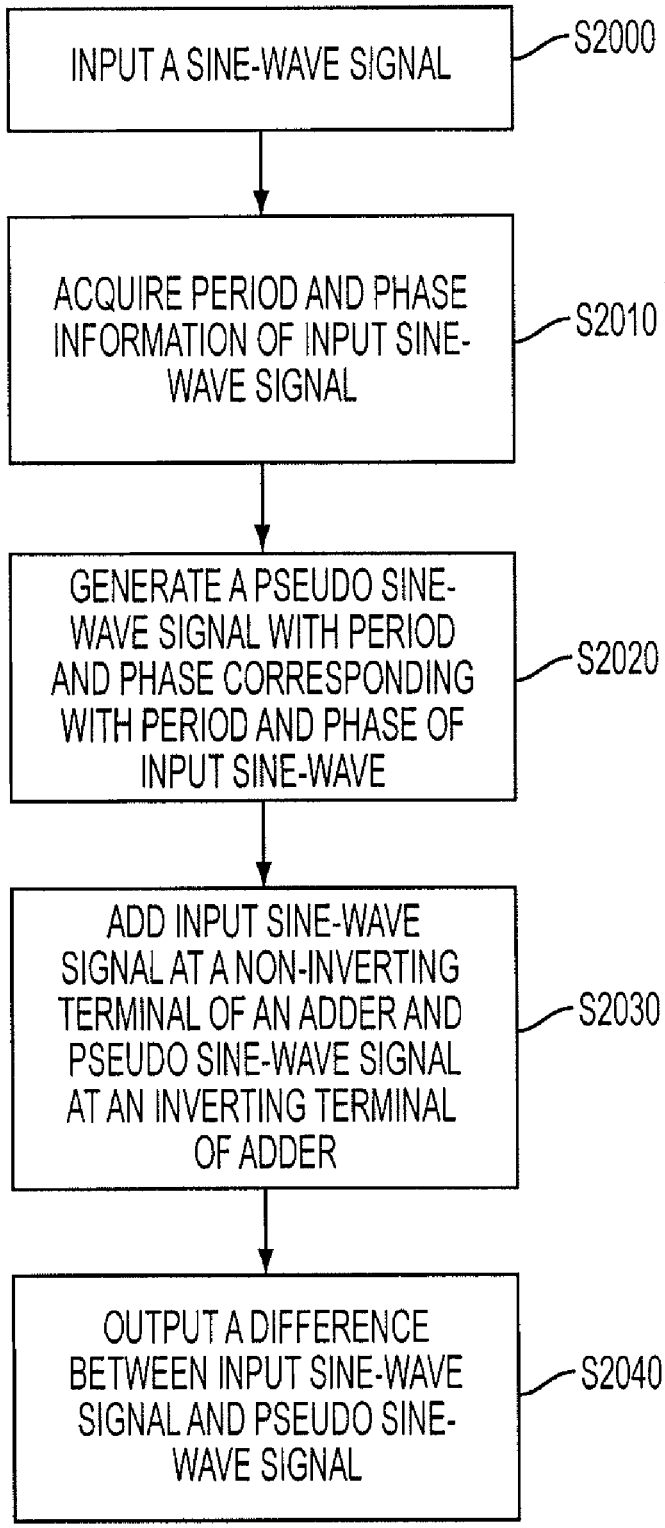
FIG. 20 is a flowchart illustrating a method of detecting a desired signal in the presence of jammer signals according to the exemplary embodiments of the invention.

Exemplary embodiments of the invention also provide a method of detecting a desired signal in the presence of jammer signals. FIG. 20 is a flow chart illustrating a method of detecting a desired signal in the presence of jammer signals according to the exemplary embodiments of the present invention.

As shown in FIG. 20, a method of detecting a desired signal in the presence of jammer signals may include inputting a sine-wave signal (S2000), acquiring information of period and phase of the input sine-wave signal with a detector (S2010), generating a pseudo sine-wave signal whose period and phase correspond with the period and phase of the input sine-wave signal of a pseudo sine-wave generator (S2020), adding the input sine-wave signal at a non-inverting terminal of an adder and the pseudo sine-wave signal at an inverting terminal of the adder (S2030), and outputting a difference between the input sine-wave signal and the pseudo sine-wave signal (S2040).

Figure 21:
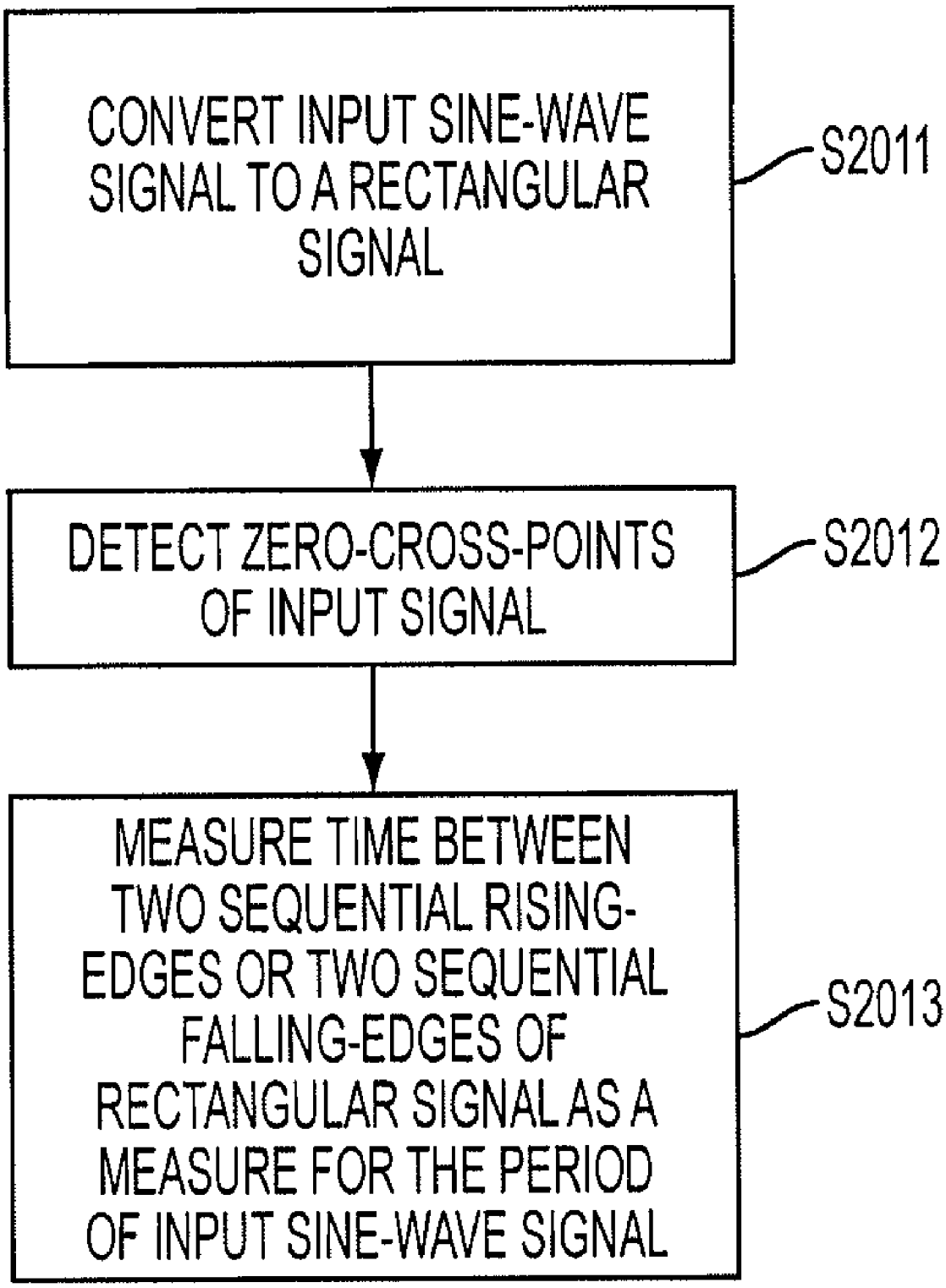
FIG. 21 is another flowchart illustrating a method of detecting a desired signal in the presence of jammer signals according to the exemplary embodiments of the invention.

FIG. 21 is another flow chart illustrating a method of detecting a desired signal in the presence of jammer signals according to the exemplary embodiments of the present invention.

As shown in FIG. 21, the acquisition of period and phase information may include converting the input sine-wave signal to a rectangular signal (S2011), detecting a zero-cross-point of the input signal (S2012), and measuring the time between two sequential rising-edges or two sequential falling-edges of the rectangular signal as the period of the input sine-wave signal (2013).

Figure 22:
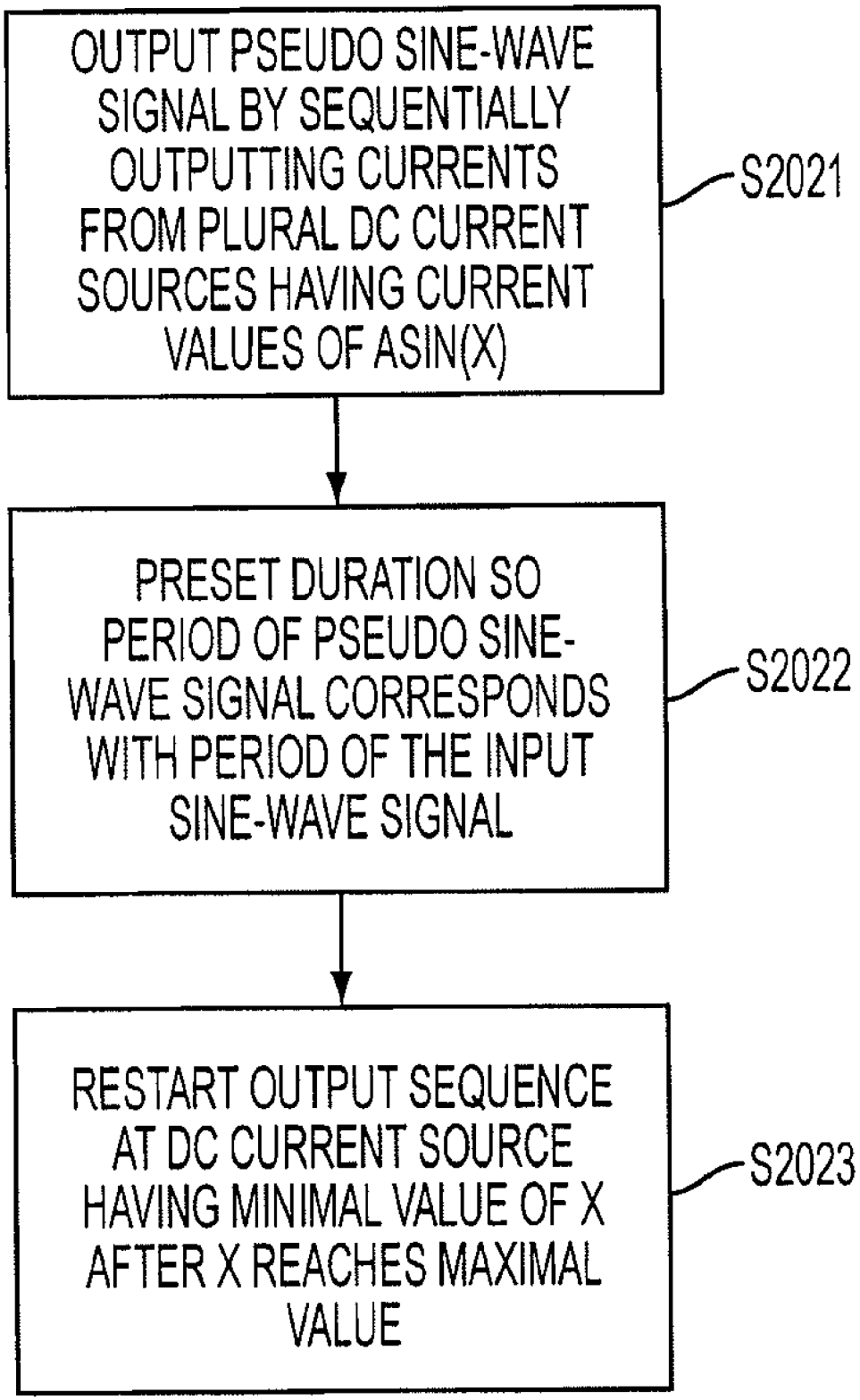
FIG. 22 is another flowchart illustrating a method of detecting a desired signal in the presence of jammer signals according to the exemplary embodiments of the invention.

FIG. 22 is another flow chart illustrating a method of detecting a desired signal in the presence of jammer signals according to the exemplary embodiments of the present invention.

As shown in FIG. 22, the generating a pseudo sine-wave signal may include outputting a pseudo sine-wave signal by sequentially outputting currents from plural DC current sources having current values of A sin(x), where A is preset and x is a number in a range from 0 to 2π, in increasing order of x in a preset duration (S2021), presetting the duration so that a period of the pseudo sine-wave signal corresponds with a period of the input sine-wave signal (S2022), and restarting the output sequence at the DC current source having a minimal value of x after x reaches a maximal value (S2023).

While the embodiments of the present invention have been described, additional variations and modifications of the embodiments may occur to those skilled in the art once they learn of the basic inventive concepts. It will be understood by those skilled in the art that various changes in form and details may be made therein without departing from the spirit and scope of the invention as defined by the appended claims. Therefore, it is intended that the appended claims shall be construed to include both the above embodiments and all such variations and modifications that fall within the spirit and scope of the invention.

What is claimed is:

1. A filtering circuit, comprising:

a jammer generator, comprising:

a detector which detects information of period and phase of an input composite signal, which includes a jammer signal and a desired signal received at an antenna, input to the jammer generator; and a pseudo sine-wave generator which outputs, as an output of the jammer generator, a pseudo sine-wave signal whose period and phase correspond with the period and phase of the input composite signal detected by the detector; and an adder which outputs a difference between the input composite signal and the pseudo sine-wave signal output by the jammer generator as the desired signal.

2. The filtering circuit according to claim 1, wherein the detector converts the input sinusoidal jammer signal to a rectangular signal and measures a time between two sequential rising-edges or two sequential falling-edges of the rectangular signal as the period of the input composite signal.

3. The filtering circuit according to claim 1, wherein the detector has a zero-cross-point detection circuit which detects a zero-cross point of the input composite signal.

4. The filtering circuit according to claim 1, wherein the pseudo sine-wave generator has plural DC current sources with current values of Asin(x), where A is preset and x is a number in a range from 0 to 2π, and outputs the pseudo sine-wave signal by sequentially outputting current from the plural DC current sources in increasing order of x in a preset duration, wherein the output sequence is restarted at the DC current source having a minimal value of x after x reaches a maximal value.

5. The filtering circuit according to claim 2, wherein the pseudo sine-wave generator has plural DC current sources with current values of Asin(x), where A is preset and x is a number in a range from 0 to 2π, and outputs the pseudo sine-wave signal by sequentially outputting current from the plural DC current sources in increasing order of x in a preset duration, wherein the output sequence is restarted at a DC current source having a minimal value of x after x reaches a maximal value, and the preset duration is set so that the period of the pseudo sine-wave signal corresponds with the period of the input composite signal measured at the detector.

6. The filtering circuit according to claim 3, wherein the pseudo sine-wave generator has plural DC current sources with current values of Asin(x), where A is preset and x is a number in a range from 0 to 2π, and outputs the pseudo sine-wave signal by sequentially outputting current from the plural DC current sources in order of x in a preset duration, wherein the output sequence is restarted at a DC current source having a minimal value of x after x reaches a maximal value or the zero-cross-point detection circuit detects zero-cross point for the input composite signal.

7. A filtering circuit, comprising:

a jammer generator, comprising:

a detector which detects information of period and phase of an input composite signal, which includes a jammer signal and a desired signal received at an antenna, input to the jammer generator; and a pseudo sine-wave generator which outputs, as an output of the jammer generator, a pseudo sine-wave signal whose period and phase correspond with the period and phase of the input composite signal detected by the detector;

an adder which outputs a difference between the input composite signal and the pseudo sine-wave signal output by the jammer generator as the desired signal; and a variable gain amplifier which inputs the composite signal and outputs a signal to an input of the jammer generator, wherein a gain of the variable gain amplifier is adjusted so that an amplitude of the output signal of the variable gain amplifier corresponds with an amplitude of the pseudo sine-wave signal output from the jammer generator.

8. A filtering circuit, comprising:

a jammer generator, comprising:

a detector which detects information of period and phase of an input composite signal, which includes a jammer signal and a desired signal received at an antenna, input to the jammer generator; and a pseudo sine-wave generator which outputs, as an output of the jammer generator, a pseudo sine-wave signal whose period and phase correspond with the period and phase of the input composite signal detected by the detector;

an adder which outputs a difference between the input composite signal and the pseudo sine-wave signal output by the jammer generator as the desired signal;

a variable gain amplifier which inputs the composite signal and outputs a signal to an input of the jammer generator, and a gain controlling circuit which includes a circuit for detecting information of an amplitude of the input composite signal and adjusting a gain of the variable gain amplifier so that an amplitude of the output signal of the variable gain amplifier corresponds with an amplitude of the pseudo sine-wave signal output from the jammer generator.

9. A filtering circuit, comprising:

a variable amplitude jammer generator, comprising:

a detector which detects information of period and phase of an input composite signal, which includes a jammer signal and a desired signal received at an antenna, input to the variable amplitude jammer generator; and a pseudo sine-wave generator with a variable amplitude function which outputs, as an output of the variable amplitude jammer generator, a pseudo sine-wave signal whose period and phase correspond with the period and phase of the input composite signal detected by the detector; and an adder which outputs a difference between the input composite signal and the pseudo sine-wave signal output by the variable amplitude jammer generator as the desired signal.

10. A filtering circuit, comprising:

a variable amplitude jammer generator, comprising:

a detector which detects information of period and phase of an input composite signal, which includes a jammer signal and a desired signal received at an antenna, input to the variable amplitude jammer generator; and a pseudo sine-wave generator with a variable amplitude function which outputs, as an output of the variable amplitude jammer generator, a pseudo sine-wave signal whose period and phase correspond with the period and phase of the input composite signal detected by the detector;

an adder which outputs a difference between the input composite signal and the pseudo sine-wave signal output by the variable amplitude jammer generator as the desired signal; and an amplitude controller which controls an output signal amplitude of the pseudo sine-wave generator in the variable amplitude jammer generator so that the amplitude of the pseudo sine-wave signal output from the pseudo sine-wave generator corresponds with an amplitude of the input composite signal to the variable amplitude jammer generator.

11. A filtering circuit, comprising:

a variable gain amplifier which inputs a composite sinusoidal signal, which includes a jammer signal and a desired signal received at an antenna, and outputs a composite signal having an amplitude adjusted jammer signal;

a controller which controls a gain of the variable gain amplifier;

a jammer generator which inputs an amplitude adjusted composite signal and outputs a sinusoidal signal having a preset amplitude and a same frequency and phase as the amplitude adjusted composite signal; and an adder which inputs the amplitude adjusted composite signal at a positive terminal and inputs the sinusoidal signal having a preset amplitude from the jammer generator at a negative terminal, and outputs a signal proportional to the difference between the signals input at the positive and negative terminals as the desired signal.

12. The filtering circuit according to claim 11, wherein the jammer generator comprises:

a comparator which accepts the amplitude adjusted composite signal and outputs a high logic level signal when the amplitude adjusted composite signal is greater than zero and a low logic level signal when the amplitude adjusted composite signal is less than or equal to zero;

a detector which detects information of period and phase of the amplitude adjusted composites signal based on the logic signals output from the comparator; and a pseudo sine-wave generator which outputs, as an output of the jammer generator, a pseudo sine-wave signal whose period and phase correspond with the period and phase information of the amplitude adjusted composite signal acquired by the detector.

13. A filtering circuit, comprising:

a voltage-current converter having a preset conversion gain which inputs a composite sinusoidal voltage signal, which includes a jammer signal and a desired signal received at an antenna, and outputs a first sinusoidal current signal;

a variable amplitude jammer generator which inputs the first sinusoidal current signal and outputs a second sinusoidal current signal having a same frequency and phase as the first sinusoidal current signal;

a controller which controls the variable amplitude jammer generator to adjust an amplitude of the second sinusoidal current signal; and an adder which inputs the first sinusoidal current signal from the voltage-current converter at a positive terminal and inputs the second sinusoidal current signal from the variable amplitude jammer generator at a negative terminal, and outputs a voltage proportional to a difference between the signals input at the positive and negative terminals as the desired signal.

14. The filtering circuit according to claim 13, wherein the variable amplitude jammer generator comprises:

a comparator which accepts the first sinusoidal current signal and outputs a high logic level signal when the an amplitude of the first sinusoidal current signal is greater than zero and a low logic level signal when the amplitude of the first sinusoidal current signal is less than or equal to zero a detector which detects information of period and phase of the first sinusoidal current signal based on the logic signals output from the comparator; and a variable amplitude sine-wave generator which adjusts the amplitude of the second sinusoidal current signal based on input from the controller, and outputs the amplitude adjusted second sinusoidal current signal as an output of the jammer generator.

* * * * *